US010626662B2

(12) United States Patent
Philips

(10) Patent No.: US 10,626,662 B2
(45) Date of Patent: Apr. 21, 2020

(54) WINDOW FRAME SYSTEM, THERMALLY INSULATING ELEMENT, METHOD, WINDOW FRAME STRUCTURE, FLEXIBLE PROFILE, CONTROL SYSTEM AND SUN PROTECTION SYSTEM

(71) Applicant: Mindow Holding B.V., Maastricht (NL)

(72) Inventor: Jeroen Albert Jan Philips, Meerssen (NL)

(73) Assignee: POLIM B.V., Munstergeleen (NL)

( * ) Notice: Subject to any disclaimer, the term of this patent is extended or adjusted under 35 U.S.C. 154(b) by 0 days.

(21) Appl. No.: 15/540,538

(22) PCT Filed: Dec. 29, 2015

(86) PCT No.: PCT/NL2015/050914
§ 371 (c)(1),
(2) Date: Jun. 28, 2017

(87) PCT Pub. No.: WO2016/108689
PCT Pub. Date: Jul. 7, 2016

(65) Prior Publication Data

US 2017/0350186 A1 Dec. 7, 2017

(30) Foreign Application Priority Data

Dec. 29, 2014 (NL) ..... 2014067
Feb. 4, 2015 (NL) ..... 1041173
Feb. 8, 2015 (NL) ..... 1041177

(51) Int. Cl.
*E06B 3/62* (2006.01)
*E06B 3/263* (2006.01)
(Continued)

(52) U.S. Cl.
CPC ..... *E06B 3/62* (2013.01); *E06B 3/12* (2013.01); *E06B 3/20* (2013.01); *E06B 3/2632* (2013.01);
(Continued)

(58) Field of Classification Search
CPC ..... E06B 3/62; E06B 3/2632; E06B 3/5828; E06B 3/20; E06B 3/12; E06B 3/26301;
(Continued)

(56) References Cited

U.S. PATENT DOCUMENTS 2,872,713 A * 2/1959 Haas ..... E06B 3/26301 49/DIG. 1
2,877,515 A * 3/1959 Haas ..... E06B 3/26301 52/172
(Continued)

FOREIGN PATENT DOCUMENTS

FR 1 498 145 A 10/1967
FR 2 986 554 A1 8/2013
GB 2 413 145 A 10/2005

OTHER PUBLICATIONS

Machine translation of FR2986554 (Year: 2019).*
International Search Report, dated Oct. 7, 2016, from corresponding PCT application No. PCT/NL2015/050914.

*Primary Examiner* — Brent W Herring
(74) *Attorney, Agent, or Firm* — Young & Thompson

(57) ABSTRACT

A window frame system for fixing at least a first panel, includes at least a first window frame structure which includes at least a first window frame profile having at least first and second holders, and at least a first thermally insulating element with sixth and seventh holders. The second holder and the sixth and/or the seventh holder of the first thermally insulating element include at least one internal corner with a radius smaller than 0.5 mm. In this way, the dimensions of the window frame profile may be smaller than
(Continued)

in the known window frame profiles. This may be advantageous for the total insulation value of the window frame system and the quantity of material required/used for the window frame profiles. Also disclosed is a thermally insulating element, a method, a window frame structure, a flexible profile, a control system and a sun protection system.

17 Claims, 8 Drawing Sheets

(51) Int. Cl.
*E06B 3/12* (2006.01)
*E06B 3/20* (2006.01)
*E06B 3/58* (2006.01)

(52) U.S. Cl.
CPC ..... *E06B 3/26301* (2013.01); *E06B 3/5828* (2013.01); *E06B 3/5821* (2013.01); *E06B 2003/2631* (2013.01); *E06B 2003/2637* (2013.01); *E06B 2003/2639* (2013.01); *E06B 2003/26309* (2013.01); *E06B 2003/26312* (2013.01); *E06B 2003/26332* (2013.01); *E06B 2003/26352* (2013.01); *E06B 2003/26359* (2013.01); *E06B 2003/26361* (2013.01); *E06B 2003/26387* (2013.01); *E06B 2003/26389* (2013.01); *E06B 2003/26392* (2013.01); *E06B 2003/26394* (2013.01); *E06B 2003/6214* (2013.01); *E06B 2003/6223* (2013.01); *E06B 2003/6241* (2013.01); *E06B 2003/6244* (2013.01); *E06B 2003/6247* (2013.01); *E06B 2003/6261* (2013.01); *E06B 2003/6264* (2013.01); *E06B 2003/6273* (2013.01); *E06B 2003/6288* (2013.01)

(58) Field of Classification Search
CPC ... E06B 2003/2639; E06B 2003/26389; E06B 2003/26387; E06B 2003/26361; E06B 2003/26359; E06B 2003/26312; E06B 2003/2631; E06B 2003/26394; E06B 2003/6273; E06B 2003/6261; E06B 2003/6247; E06B 2003/6244; E06B 2003/6241; E06B 2003/6223; E06B 2003/6214; E06B 2003/6288; E06B 2003/26392; E06B 2003/2637; E06B 2003/26352; E06B 2003/26332; E06B 2003/26309; E06B 3/5821; E06B 2003/6264
USPC ..... 52/204.1, 213, 204.597
See application file for complete search history.

(56) References Cited

U.S. PATENT DOCUMENTS 3,016,993 A * 1/1962 Owen ..... E06B 1/045 52/204.591
3,024,881 A * 3/1962 Haas ..... E06B 3/26301 52/204.593
3,090,083 A 5/1963 Emmerich
3,093,217 A * 6/1963 Doede ..... E04B 2/96 49/DIG. 1
6,202,353 B1 * 3/2001 Giacomelli ..... E06B 3/2632 49/504
7,694,472 B2 * 4/2010 Rawlings ..... E06B 3/2675 52/204.1
7,987,633 B2 * 8/2011 Lenox ..... E06B 3/26303 49/504
8,286,396 B2 * 10/2012 Brunnhofer ..... E06B 3/26303 49/501
9,683,402 B2 * 6/2017 Abdul Lathief .... E06B 3/66304
9,797,185 B2 * 10/2017 Abdul Lathief .... E06B 3/66304
2004/0025454 A1 2/2004 Burgess
2005/0115183 A1 * 6/2005 Rawlings ..... E06B 3/2675 52/578
2010/0018140 A1 * 1/2010 Brunnhofer ..... E06B 3/26303 52/204.71
2014/0260064 A1 * 9/2014 Hensley ..... E06B 3/273 52/656.9
2014/0318050 A1 * 10/2014 Lathief ..... E06B 3/66304 52/204.595
2015/0007514 A1 * 1/2015 Lathief ..... E06B 3/66304 52/204.66
2016/0356077 A1 * 12/2016 Bourly ..... E06B 3/9641
2018/0179805 A1 * 6/2018 Niehausmeier ..... E05C 1/00

* cited by examiner

WINDOW FRAME SYSTEM, THERMALLY INSULATING ELEMENT, METHOD, WINDOW FRAME STRUCTURE, FLEXIBLE PROFILE, CONTROL SYSTEM AND SUN PROTECTION SYSTEM

BACKGROUND OF THE INVENTION

Field of the Invention

The invention concerns a window frame system for fixing at least a first panel comprising at least two plates which extend parallel to each other. The window frame system comprises at least a first window frame structure which comprises at least a first window frame profile and a first thermally insulating element. The invention furthermore concerns a thermally insulating element for use in the window frame system according to the invention. In addition, the invention concerns a method for implementing aspects of the window frame system according to the invention, a flexible profile for sealing openings between the at least first panel and the first window frame structure of the window frame system according to the invention, a control system for use in the window frame system according to the invention, and a sun protection system for use in the window frame system according to the invention.

Description of the Related Art

Window frame systems known from the prior art comprise usually tubular window frame profiles with large dimensions necessary for the installation of connecting elements which are used to connect the window frame profiles together in order to assemble the window frame system. For given dimensions of a recess in a wall, for example for a window, after installation of the window frame system, due to the relatively wide window frame profiles which for example comprise aluminium, a relatively small area remains for the passage of light through the window. Due to the relatively large dimensions of the window frame profiles, the window frame profiles are clearly visible. An insulating panel supported by the window frame profiles, for example an insulating glass panel, has a better thermal insulation value than the window frame profiles. Due to the relatively wide window frame profiles, the thermal insulation value of the window frame is relatively limited.

BRIEF SUMMARY OF THE INVENTION

It is an object of the invention to produce a window frame system which eliminates or at least reduces the above-mentioned disadvantages of window frame systems known from the prior art. Furthermore, the invention concerns the provision of a window frame system with the smallest possible dimensions and an improved insulation value of the total window frame system. This leads to a window frame system which uses as little material as possible, allows as much light as possible to pass to the inside through the window and door frame, and allows the use of more glass and/or more wall space which gives a better thermal insulation value. The total thermal insulation of a window frame-glass-wall combination is better if the proportion of the most poorly insulating part, the window frame, is reduced.

At least one of these objects is achieved by a window frame system according to the invention, wherein the window frame system comprises at least a first window frame structure, wherein the first window frame structure comprises at least a first window frame profile which is provided with at least a first holder and a second holder; at least a first thermally insulating element which comprises at least a first end and a second end, wherein the first end can be received in the first holder of the at least first window frame profile, wherein the at least first thermally insulating element is provided with at least one of a sixth holder and a seventh holder, wherein the sixth holder is oriented towards the second end and the seventh holder is oriented towards the first end; at least a first flexible profile which comprises a first sealing element which can be coupled to at least the first window frame profile and a first plate of a first panel which can be received in the window frame system; at least a first glass lath which can be coupled to a second plate of the first panel and the at least first thermally insulating element; wherein the second holder of the at least first window frame profile and the sixth holder and/or the seventh holder of the at least first thermally insulating element comprise at least one internal corner with a radius which is smaller than 0.5 mm. By using holders with internal corners which have a radius smaller than 0.5 mm, there is no need to take account of minimum dimensions required for surface treatment. In the window frame system according to the invention, this is achieved by using the holders in the system only where no surface treatment is necessary. In this way, the dimensions of the window frame profile may be smaller than in window frame profiles already known. This may be advantageous for the total insulation value of the window frame and the quantity of material required/used for the window frame profiles.

In an embodiment of the window frame system according to the invention, the first flexible profile furthermore comprises at least a first coupling element and a second coupling element, wherein the first coupling element can be received in the second holder of the at least first window frame profile, and the second coupling element can be received in the sixth holder of the at least first thermally insulating element.

In an embodiment of the window frame system according to the invention, the at least first glass lath comprises at least a third coupling element which can be received in the seventh holder of the at least first thermally insulating element. The abovementioned embodiments of the window frame system according to the invention concern the provision of an insulated window frame profile/window frame structure with holder for glass laths and/or glazing rubbers/first flexible profile, wherein the holders are integrated in the isolator/thermally insulating element. In this way, the depth of the isolator is not limited to the location of the holder of the glass lath or the rubber in the shell part which does not give good insulation. Therefore the isolator can allow the omission of a shell part, for example the second shell part. The window frame profile may thus consist of only two shell parts, namely the first (metal, e.g. aluminium) window frame profile and the thermally insulating element, instead of three, namely the first (metal, e.g. aluminium) window frame profile, the second (metal, e.g. aluminium) window frame profile and the thermally insulating element which connects the first and second window frame profiles together. Because the isolator is deeper, the insulation value of the profile/window frame structure is improved and hence also the insulation value of the total window frame.

In an embodiment of the window frame system according to the invention, the window frame system furthermore comprises a second window frame profile which is provided with at least a fourth holder, wherein the second end of the at least first thermally insulating element can be received in the fourth holder for connecting together at least the first window frame profile and the second window frame profile. In this way a window frame structure can be obtained comprising two metal, e.g. aluminium, window frame profiles that are connected together via a thermally insulating element.

In an embodiment of the window frame system according to the invention, the first holder and the second holder of the at least first window frame profile are oriented towards the fourth holder of the second window frame profile.

In an embodiment of the window frame system according to the invention, the at least first window frame profile and/or the second window frame profile is provided with at least a first cavity which forms an open passage between a first side and a second side of the respective window frame profile in which the cavity is provided. The cavity may have the function of a screw channel which allows the window frame profiles, positioned at right angles to each other, to be connected together by means of at least one screw connection.

In an embodiment of the window frame system according to the invention, the first end of the first thermally insulating element can be connected to the first holder of the first window frame profile by means of at least one of an adhesive connection and a mechanical connection.

In an embodiment of the window frame system according to the invention, the second end of the first thermally insulating element can be connected to the fourth holder of the second window frame profile by means of at least one of an adhesive connection and a mechanical connection.

In an embodiment of the window frame system according to the invention, the mechanical connection comprises at least one of a punch connection, a clamp connection, a rivet connection, a push-fit connection and a screw connection. The abovementioned connection ways have the advantage that in this way, the dimensions of the isolator and the holders of the half-shells and hence the window frame profile may be smaller than in window frame profiles already known. This may be advantageous for the total insulation value of the window frame and the quantity of material required/used for the window frame profiles.

In an embodiment of the window frame system according to the invention, the at least first thermally insulating element is an elongated strip.

In an embodiment of the window frame system according to the invention, the thermally insulating element is provided with at least one cavity. In this way, it is possible to limit the heat transfer through the window frame profiles while the mechanical properties remain as high as possible. Furthermore, in this way, it is possible to make the insulation value and strength of the assembled window frame profiles as high as possible. This may be advantageous for the total insulation value of the window frame and the quantity of material required/used for the window frame profiles.

In an embodiment of the window frame system according to the invention, the at least first thermally insulating element has a thermal conduction coefficient which is smaller by at least two orders of magnitude than the thermal conduction coefficient of the at least first window frame profile and the second window frame profile.

In an embodiment of the window frame system according to the invention, the at least first thermally insulating element comprises at least one of a bullet-proof material, a fire-resistant material and a sound-insulating material.

In an embodiment of the window frame system according to the invention, the window frame system comprises at least one of a biological material, a composite material, a plastic and a flexible material.

In an embodiment of the window frame system according to the invention, the at least first thermally insulating element comprises at least one of a biological material, a composite material and a flexible material.

In an embodiment of the window frame system according to the invention, the flexible material comprises an armoured flexible material.

In an embodiment of the window frame system according to the invention, the at least first window frame profile and the second window frame profile comprise materials which are transparent to visible light. By making the window frame profiles transparent, the quantity of light which enters an interior room is maximised. In this way it is possible to choose a minimal dimension for a hole in for example a wall in which the window frame structure will be installed while sufficient daylight will be allowed to enter in the room. As a result, a smaller window frame system may suffice, leaving more wall area with better insulation to be used instead.

In an embodiment of the window frame system according to the invention, the at least first thermally insulating element comprises at least one of a plastic and a fibre-reinforced material.

In an embodiment of the window frame system according to the invention, the at least first window frame profile and the second window frame profile comprise at least one of aluminium, an aluminium alloy and anodised aluminium.

In an embodiment of the window frame system according to the invention, the window frame system further comprises a connecting element for connecting together the at least first window frame structure and an at least second window frame structure, wherein the connecting element comprises a first end which can be received in the at least first cavity of the thermally insulating connecting element of the at least first window frame structure, and a second end which can be received in an at least first cavity of a thermally insulating connecting element of the at least second window frame structure. The person skilled in the art will appreciate that the connecting element can for example be a corner connector or a T-profile.

According to an aspect of the invention, there is provided a thermally insulating element for use in a window frame system according to the invention. The at least first thermally insulating element comprises a first end and a second end, wherein the first end can be received in the first holder of the at least first window frame profile, wherein the at least first thermally insulating element is provided with at least one of a sixth holder and a seventh holder, wherein the sixth holder is oriented towards the second end, and the seventh holder is oriented towards the first end. Such a thermally insulating profile enables the provision of an insulated window frame profile/window frame structure with holder for glass laths and/or glazing rubbers/first flexible profile, wherein the holders are integrated in the isolator/thermally insulating element. In this way, the depth of the isolator is not limited to the location of the holder of the glass lath or the rubber in the shell part which does not give good insulation. Therefore the isolator can allow the omission of a shell part, for example the second shell part. The window frame profile may thus consist of only two shell parts, namely the first (metal, e.g. aluminium) window frame profile and the thermally insulating element, instead of three, namely the first (metal, e.g. aluminium) window frame profile, the second (metal, e.g. aluminium) window frame profile and the thermally insulating element which connects the first and second window frame profiles together. Because the isolator is deeper, the insulation value of the profile/window frame structure is improved and hence also the insulation value of the total window frame.

In an embodiment of the thermally insulating element according to the invention, at least one of the sixth holder and the seventh holder comprises at least one internal corner with a radius smaller than 0.5 mm. By using holders with internal corners which have a radius smaller than 0.5 mm, there is no need to take account of minimum dimensions required for surface treatment. In the window frame system according to the invention, this is achieved by using the holders in the system only where no surface treatment is necessary. In this way, the dimensions of the window frame profile may be smaller than in window frame profiles already known. This may be advantageous for the total insulation value of the window frame and the quantity of material required/used for the window frame profiles.

In an embodiment of the thermally insulating element according to the invention, the thermally insulating element is an elongated strip.

In an embodiment of the thermally insulating element according to the invention, the thermally insulating element is provided with at least one cavity. In this way the heat transmission of the thermally insulating element and the total window frame system can further be reduced.

In an embodiment of the thermally insulating element according to the invention, the thermally insulating element comprises at least one of a bullet-proof material, a fire-resistant material and a sound-insulating material.

In an embodiment of the thermally insulating element according to the invention, the thermally insulating element comprises at least one of a biological material, a composite material, a plastic and a flexible material.

In an embodiment of the thermally insulating element according to the invention, the flexible material comprises an armoured flexible material.

In an embodiment of the thermally insulating element according to the invention, the thermally insulating element comprises at least one of a plastic and a fibre-reinforced material.

According to an aspect of the invention, there is provided a connecting element for connecting together an at least first window frame structure and an at least second window frame structure of a window frame system according to the invention, wherein the connecting element comprises a first end which can be received in an at least first cavity of a thermally insulating connecting element of the at least first window frame structure, and a second end which can be received in an at least first cavity of a thermally insulating connecting element of the at least second window frame structure. The person skilled in the art will appreciate that the connecting element can for example be a corner connector or a T-profile.

According to an aspect of the invention, there is provided a window frame system for fixing at least one first panel, wherein the window frame system comprises at least a first window frame structure, wherein the first window frame structure comprises at least a first window frame profile which is provided with at least a first, a second and a third holder; at least a second window frame profile which is provided with at least a fourth and a fifth holder, wherein the second window frame profile can be positioned relative to the first window frame profile, wherein the first, the second and the third holders are oriented towards the fourth and the fifth holders; at least a first thermally insulating element which has at least a first end and a second end, wherein the first end can be received in the first holder and the second end can be received in the fourth holder for connecting together the first and the second window frame profiles; at least a first flexible profile which comprises a first sealing element which can be positioned in lying contact with at least the first window frame profile and a first plate of a first panel which can be received in the window frame system, wherein the first flexible profile furthermore comprises a first and a second coupling element, wherein the first coupling element can be received by form-fit in the third holder, and the second coupling element can be received by form-fit in the second holder of the first window frame profile; at least a first glass lath which can be coupled to a second plate of the first panel which can be received in the window frame system, wherein the first glass lath comprises at least a third coupling element which can be received by form fit in the fifth holder of the second window frame profile; wherein the second and the third holders of the first window frame profile, and the fifth holder of the second window frame profile, in use of the window frame system, comprise at least one internal corner with a radius smaller than 0.5 mm. By using holders with internal corners which have a radius smaller than 0.5 mm, there is no need to take account of minimum dimensions required for surface treatment. In the window frame system according to the invention, this is achieved by using the holders in the system only where no surface treatment is necessary. In this way, the dimensions of the window frame profile may be smaller than in window frame profiles already known. This may be advantageous for the total insulation value of the window frame and the quantity of material required/used for the window frame profiles.

In an embodiment of the window frame system according to the invention, the first holder and the third holder of the first window frame profile are integrated. In this way, the dimensions of the window frame profile may be smaller than in window frame profiles already known. This may be advantageous for the total insulation value of the window frame and the quantity of material required/used for the window frame profiles.

In an embodiment of the window frame system according to the invention, the fourth holder and the fifth holder of the second window frame profile are integrated. In this way, the dimensions of the window frame profile may be smaller than in window frame profiles already known. This may be advantageous for the total insulation value of the window frame and the quantity of material required/used for the window frame profiles.

In an embodiment of the window frame system according to the invention, the first end of the first thermally insulating connecting element can be glued to the first holder of the first window frame profile, and the second end of the first thermally insulating connecting element can be glued to the fourth holder of the second window frame profile. In this way, the dimensions of the isolator and the holders of the half-shells and hence the window frame profile may be smaller than in window frame profiles already known. This may be advantageous for the total insulation value of the window frame and the quantity of material required/used for the window frame profiles.

In an embodiment of the window frame system according to the invention, the at least first thermally insulating connecting element is provided with at least one cavity. In this way, it is possible to limit the heat transfer through the window frame profiles while the mechanical properties remain as high as possible. Furthermore, in this way, it is possible to make the insulation value and strength of the assembled window frame profiles as high as possible. This may be advantageous for the total insulation value of the window frame and the quantity of material required/used for the window frame profiles.

In an embodiment of the window frame system according to the invention, the at least first thermally insulating connecting element has a thermal conduction coefficient which is smaller by at least two orders of magnitude than the thermal conduction coefficient of the at least first and second window frame profiles.

In an embodiment of the window frame system according to the invention, the at least first thermally insulating connecting element comprises a fibre-reinforced material.

In an embodiment of the window frame system according to the invention, the at least first flexible profile comprises a second sealing element which can be positioned in lying contact with at least the first window frame profile and the first plate of the first panel, wherein at least the first and the second sealing elements form at least a first channel for discharging a fluid which penetrates past the first sealing element during use of the window frame system. By integrating a second sealing element with the first flexible profile it is possible to discharge a fluid, in practise usually water, which might penetrate past the first sealing element via the formed first channel or compartment to the outside before it actually penetrates the building frame, for example via the glass lath of the second window frame profile. The second sealing element in addition ensures an extra airtightness of the window frame system. Air pressure differences between interior and exterior are compartmentalised further, whereby the first channel/first (outermost) compartment can be drained towards the outside more easily.

In an embodiment of the window frame system according to the invention, the first window frame structure furthermore comprises at least a first post which can be coupled to the first or the second window frame profile; a control system which has at least a first motor which can be coupled to at least one of the first and second window frame profiles, wherein the control system furthermore comprises at least a first control unit which is configured to control the first motor for opening or closing the first window frame structure. By integrating the control system for opening and closing window leaves/window frame structures without this adversely affecting the width of the profiles it is possible to ensure a minimum width of the window frame profiles.

In an embodiment of the window frame system according to the invention, the first motor can be positioned relative to the first post or is integrated in the first glass lath.

In an embodiment of the window frame system according to the invention, the first window frame structure furthermore comprises at least a first fixing element which is configured to transfer the first window frame structure from a first closed state to a second, at least partially open state.

In an embodiment of the window frame system according to the invention, the first window frame structure furthermore comprises at least one first locking mechanism for locking or unlocking the first window frame structure.

In an embodiment of the window frame system according to the invention, the first fixing element and/or the first locking element is integrated in the first glass lath. To provide a minimum width of the window frame profiles, the first fixing element and/or the first locking element, in other words the suspension and closure fitting for opening and closing the window leaves should also be integrated in the window frame system, without this adversely affecting the width of the profiles. To achieve this, the fixing elements and/or the locking mechanisms of the window leaves/window frame structures may be integrated in the first glass lath. The window leaves/window frame structures comprise fixing elements for connecting the window leaves of the window frame system. Furthermore, the fixing elements are configured for transferring the window leaves from a first closed state to a second, at least partially open state. The window leaves furthermore comprise locking mechanisms/locks for locking and unlocking the window leaves of the window frame system. The fixing element may be a hinge which can be integrated in the glass lath. The locking mechanisms may be locks which can be integrated in the glass lath.

In an embodiment of the window frame system according to the invention, the first window frame structure furthermore comprises a first sun protection system which is integrated in the first glass lath. In this way a minimal visible width of the window frame profiles can be achieved.

In an embodiment of the window frame system according to the invention, the first window frame structure furthermore comprises at least one first autonomous control system which is configured for opening or closing the first window frame structure depending on local environmental factors, such as $CO_2$ concentration, temperature and relative humidity of the ambient air. By using an autonomous control system according to the invention it is possible to regulate ventilation locally (per window frame, per room). No central control system is required, each control system according to the invention individually controls the respective window leaves in order to create the necessary ventilation. The ventilation can thus be regulated with great accuracy. If ventilation is required locally, ventilation is provided, and if no ventilation is required, no ventilation is provided. As a result, no unnecessary hot air is ventilated.

In an embodiment of the window frame system according to the invention, the first window frame structure comprises a second flexible profile which can be applied to a side of the first glass lath which is oriented towards the second plate of the first panel to close an opening between the second window frame profile and the second plate, and/or over the first flexible profile to close an opening between the first window frame profile and the first plate of the first panel. The first flexible profile is adapted (shape, choice of material) such that it is possible to apply a second flexible profile thereon as a so-called wet glazing seal or mastic. This seal according to the invention allows a panel, for example glazing, to be applied with hook-mounted or click-fit glass laths after which the second flexible profile as a wet seal is applied by means of mastic.

In an embodiment of the window frame system according to the invention, the second flexible profile comprises a mastic.

In an embodiment of the window frame system according to the invention, the at least first thermally insulating connecting element comprises a bullet-proof material with first bullet-proof properties, and the at least first panel comprises a second bullet-proof material with second bullet-proof properties. For bullet-proof window frame systems, the panel, for example a glass plate or an assembly of glass plates, must be bullet-proof. Furthermore, the peripheral play around the glass must be smaller than the diameter of the bullet, and the isolator intended for this function must also have a bullet-proof composition.

In an embodiment of the window frame system according to the invention, the first bullet-proof properties of the first bullet-proof material, and the second bullet-proof properties of the second bullet-proof material are the same. In this way it is possible to provide a window frame system having a uniform bullet resistance. Furthermore, it is possible to fabricate the first thermally insulating connecting element and the first panel from the same material.

In an embodiment of the window frame system according to the invention, the at least first thermally insulating connecting element comprises a first fire-resistant material with first fire-resistant properties, and the at least first plate comprises a second fire-resistant material with second fire-resistant properties. For fire-resistant window frame systems, the glass must be fire-resistant. Furthermore, the peripheral play must be filled with fire-resistant material, e.g. at least one of a tape, a film and paint. The person skilled in the art will appreciate that more types and combinations of fire-resistant materials can be applied. In addition, the isolator intended for this function must have a fire-resistant composition.

In an embodiment of the window frame system according to the invention, the first fire-resistant properties of the first fire-resistant material and the second fire-resistant properties of the second fire-resistant material are the same. In this way it is possible to provide a window frame system having a uniform fire resistance. Furthermore, it is possible to fabricate the first thermally insulating connecting element and the first panel from the same material.

In an embodiment of the window frame system according to the invention, the at least one first thermally insulating connecting element comprises a first sound-insulating material with first sound-insulating properties, and the at least first plate comprises a second sound-insulating material with second sound-insulating properties. For sound-insulating window frame systems the panel, for example a glass plate or an assembly of glass plates, must be sound-insulating. Furthermore, the peripheral play around the panel must be filled with a sound-insulating material and the isolator intended for this function must have a sound-insulating composition.

In an embodiment of the window frame system according to the invention, the first sound-insulating properties of the first sound-insulating material and the second sound-insulating properties of the second sound-insulating material are the same. In this way it is possible to provide a window frame system having a uniform sound resistance. Furthermore, it is possible to fabricate the first thermally insulating connecting element and the first panel from the same material.

In an embodiment of the window frame system according to the invention, the at least one first thermally insulating connecting element comprises a first thermally insulating material with first thermally insulating properties, and the at least first plate comprises a second thermally insulating material with second thermally insulating properties. For thermally insulating window frame systems the panel, for example a glass plate or an assembly of glass plates, must offer good thermal insulation. Furthermore, the peripheral play must be filled with a material with good thermal insulation or stationary air, and the isolator intended for this function must have good thermal insulation.

In an embodiment of the window frame system according to the invention, the first thermally insulating properties of the first thermally insulating material and the second thermally insulating properties of the second thermally insulating material are the same. In this way it is possible to provide a window frame system having a uniform thermal insulation. Furthermore, it is possible to fabricate the first thermally insulating connecting element and the first panel from the same material.

In an embodiment of the window frame system according to the invention, the window frame system comprises at least one of a biological material, a plastic, a composite material and a flexible material. By applying one of these materials or combination of these materials it is possible to provide window frame systems having at least one of bullet-proof, fire-resistant, sound-insulating and thermally insulating properties. By applying one of the mentioned materials or combination of these materials it is possible to integrate for example at least the first flexible sealing profile and the thermally insulating connecting element. In this way it is possible to provide a window frame structure that makes the application of the first aluminium window frame profile superfluous. It can also be envisaged to integrate the first flexible sealing profile, the thermally insulating connecting element and the second window frame profile. In this way a window frame structure can be provided in for example a flexible material, e.g. rubber, having the mechanical and strength properties which are suitable for use in a window frame system. Furthermore, it is possible to integrate the first window frame profile, the thermally insulating connecting element and the second window frame profile by implementing them in the same material. In this way, a thermally insulating window frame structure can be provided in for example a composite. The person skilled in the art will appreciate that a variety of possible materials and combinations of materials are possible within the scope of the invention. It will also be clear that application of these materials and combinations of materials provides numerous construction and/or integration possibilities for providing window frame structures and window frame systems according to the invention.

In an embodiment of the window frame system according to the invention, the at least first thermally insulating connecting element comprises at least one of a biological material, a plastic, a flexible material and a composite material. By applying one of these materials or combination of these materials it is possible to provide window frame systems having at least one of bullet-proof, fire-resistant, sound-insulating and thermally insulating properties.

In an embodiment of the window frame system according to the invention, the flexible material comprises an armoured flexible material. In this way it is possible to integrate for example at least the first flexible sealing profile and the thermally insulating connecting element. In this way it is possible to provide a window frame structure that makes the application of the first aluminium window frame profile superfluous. It can also be envisaged to integrate the first flexible sealing profile, the thermally insulating connecting element and the second window frame profile. In this way a window frame structure can be provided in for example an armoured material, e.g. an armoured rubber.

In an embodiment of the window frame system according to the invention, the window frame system comprises a fibre-reinforced material.

In an embodiment of the window frame system according to the invention, the first window frame profile and the second window frame profile comprise materials which are transparent to visible light. By making the window frame profiles transparent, the quantity of light which enters an interior room is maximised. In this way it is possible to choose a minimal dimension for a hole in for example a wall in which the window frame structure will be installed while sufficient daylight will be allowed to enter in the room. As a result, a smaller window frame system may suffice, leaving more wall area with better insulation to be used instead.

In an embodiment of the window frame system according to the invention, the window frame system according to the invention, furthermore comprises an upper element which can be coupled to the at least first glass lath on a side of the at least first glass lath which is oriented away from the second plate. In this way it is possible to determine the finish of the glass laths by means of an upper part. This finish may be applied, modified or renewed while the window frame is already provided with panels, e.g. glass plates. For modifying the finish the already installed panels do not need to be removed first.

In an embodiment of the window frame system according to the invention, the at least first window frame profile and the second window frame profile comprise at least one of aluminium, an aluminium alloy, anodised aluminium.

In an embodiment of the window frame system according to the invention, the at least first window frame profile, the at least first thermally insulating connecting element and the at least second window frame profile of the at least first window frame structure are made of a first material or a first material combination. In this way it is possible to further integrate the first window frame profile, the thermally insulating connecting element and the second window frame profile such that a further minimized first window frame structure is provided.

In an embodiment of the window frame system according to the invention, said first material or said first material combination has at least one of a bullet-proof property, a fire-resistant property and a sound-insulating property.

In an embodiment of the window frame system according to the invention, said first material or said first material combination comprises one of a plastic, a biological material, a composite material, a bio-composite material and a flexible material. By applying one of these materials or combination of these materials it is possible to provide window frame systems having at least one of the above-mentioned bullet-proof, fire-resistant, sound-insulating and thermally insulating properties. The person skilled in the art will appreciate that a variety of possible materials and combinations of materials are possible within the scope of the invention. It will also be clear that application of these materials and combinations of materials provides numerous construction and/or integration possibilities for providing window frame structures and window frame systems according to the invention.

In an embodiment of the window frame system according to the invention, the at least first window frame profile and the at least first thermally insulating connecting element form an integrated whole. This means that the at least first window frame profile and the at least first thermally insulating connecting element are made of one piece of material or a combination of materials. In this case, the second window frame profile of the window frame structure is connectable to the aforementioned integrated whole by the end of the whole being received in a fourth holder of the second window frame profile. It will be clear to the person skilled in the art that in this case the second window frame profile can comprise a different material or combination of materials, e.g. at least one of aluminium, an aluminium alloy and anodised aluminium, than the material or combination of materials that is used for the aforementioned integrated whole.

In an embodiment of the window frame system according to the invention, the at least first thermally insulating connecting element and the at least second window frame profile form an integrated whole. This means that the at least first thermally insulating connecting element and the at least second window frame profile are made of one piece of material or a combination of materials. In this case, the first window frame profile of the window frame structure is connectable to the aforementioned integrated whole by the end of the whole being received in a first holder of the first window frame profile. It will be clear to the person skilled in the art that in this case the first window frame profile can comprise a different material or combination of materials, e.g. at least one of aluminium, an aluminium alloy and anodised aluminium, than the material or combination of materials that is used for the aforementioned integrated whole.

In an embodiment of the window frame system according to the invention, the at least first window frame profile, the at least first thermally insulating connecting element and the at least second window frame profile form an integrated whole. This means that the at least first window frame profile, the at least first thermally insulating connecting element and the at least second window frame profile are made of one piece of material or combination of materials.

In an embodiment of the window frame system according to the invention, the first window frame structure comprises at least one cavity. In this way, it is possible to limit the heat transfer through the window frame profiles while the mechanical properties remain as high as possible.

In an embodiment of the window frame system according to the invention, the at least first flexible profile, the at least first thermally insulating connecting element and the at least second window frame profile of the first window frame structure are made of a second material.

In an embodiment of the window frame system according to the invention, said second material comprises a flexible material, armoured or otherwise.

In an embodiment of the window frame system according to the invention, the flexible material, armoured or otherwise, is a rubber with the mechanical and strength properties which are suitable for use in a window frame system according to the invention. In this way, a window frame structure can be provided which makes the use of a first aluminium window frame profile superfluous.

In an embodiment of the window frame system according to the invention, the at least first flexible profile and the at least first thermally insulating connecting element form an integrated whole. This means that the at least first flexible profile and the at least first thermally insulating connecting element are made of one piece of material or a combination of materials. In this case, the second window frame profile of the window frame structure is connectable to the aforementioned integrated whole by the end of the integrated whole being received in a fourth holder of the second window frame profile. It will be clear to the person skilled in the art that in this case the second window frame profile can comprise a different material or combination of materials, e.g. at least one of aluminium, an aluminium alloy and anodised aluminium, than the material or combination of materials that is used for the aforementioned integrated whole.

In an embodiment of the window frame system according to the invention, the at least first thermally insulating connecting element and the at least second window frame profile form an integrated whole. This means that the at least first thermally insulating connecting element and the at least second window frame profile are made of one piece of material or a combination of materials. In this case, the first flexible profile of the window frame structure is connectable to the aforementioned integrated whole by a first connecting element of the first flexible profile being received in a sixth holder of the integrated whole. It will be clear to the person skilled in the art that in this case the first flexible profile can comprise a different material or combination of materials than the material or combination of materials that is used for the aforementioned integrated whole.

In an embodiment of the window frame system according to the invention, the at least first flexible profile, the at least first thermally insulating connecting element and the at least second window frame profile form an integrated whole. This means that the at least first flexible profile, the at least first thermally insulating connecting element and the at least second window frame profile are made of one piece of material or combination of materials.

In an embodiment of the window frame system according to the invention, the window frame system furthermore comprises a connecting element for connecting together the at least first window frame structure and an at least second window frame structure, wherein the connecting element comprises a first end which can be received in the at least first cavity of the thermally insulating connecting element of the at least first window frame structure, and a second end which can be received in an at least first cavity of a thermally insulating connecting element of the at least second window frame structure. The person skilled in the art will appreciate that the connecting element can for example be a corner connector or a T-profile.

According to an aspect of this invention, there is provided a method for manufacture of a window frame system according to the invention, wherein the method comprises a step in which a surface treatment of the at least first glass lath is applied in a line during extrusion or pultrusion of the first glass lath. In this way a more efficient production process of the glass lath can be ensured.

In an embodiment of the method for manufacture of a window frame system according to the invention, the method furthermore comprises a step in which a surface treatment of the at least first window frame profile and the at least second window frame profile are carried out in a line during extrusion or pultrusion of the first window frame profile and the second window frame profile. In this way a more efficient production process of the window frame profiles can be ensured.

According to an aspect of this invention, there is provided a window frame structure for use in a window frame system according to the invention, comprising at least a first window frame profile, at least a second window frame profile and an at least first thermally insulating connecting element which is connected with a first end to the first window frame profile and with a second end to the second window frame profile, wherein the first window frame profile, the first thermally insulating connecting element and the second window frame profile are made of a first material or a first material combination.

In an embodiment of the window frame structure according to the invention, said first material or said first material combination has at least one of a bullet-proof property, a fire-resistant property and a sound-insulating property.

In an embodiment of the window frame structure according to the invention, said first material or said first material combination comprises one of a plastic, a biological material, a composite material, a bio-composite material and a flexible material.

In an embodiment of the window frame structure according to the invention, the at least first window frame profile and the at least first thermally insulating connecting element form an integrated whole. This means that the at least first window frame profile and the at least first thermally insulating connecting element are made of one piece of material or a combination of materials. In this case, the second window frame profile of the window frame structure is connectable to the aforementioned integrated whole by the end of the integrated whole being received in a fourth holder of the second window frame profile. It will be clear to the person skilled in the art that in this case the second window frame profile can comprise a different material or combination of materials, e.g. at least one of aluminium, an aluminium alloy and anodised aluminium, than the material or combination of materials that is used for the aforementioned integrated whole.

In an embodiment of the window frame structure according to the invention, the at least first thermally insulating connecting element and the at least second window frame profile form an integrated whole. This means that the at least first thermally insulating connecting element and the at least second window frame profile are made of one piece of material or a combination of materials. In this case, the first window frame profile of the window frame structure is connectable to the aforementioned integrated whole by the end of the whole being received in a first holder of the first window frame profile. It will be clear to the person skilled in the art that in this case the first window frame profile can comprise a different material or combination of materials, e.g. at least one of aluminium, an aluminium alloy and anodised aluminium, than the material or combination of materials that is used for the aforementioned integrated whole.

In an embodiment of the window frame structure according to the invention, the at least first window frame profile, the at least first thermally insulating connecting element and the at least second window frame profile form an integrated whole. This means that the at least first window frame profile, the at least first thermally insulating connecting element and the at least second window frame profile are made of one piece of material or a combination of materials.

In an embodiment of the window frame structure according to the invention, the first window frame structure is provided with at least one cavity.

In an embodiment of the window frame structure according to the invention, the window frame structure comprises at least a first flexible profile, at least a second window frame profile and at least a first thermally insulating connecting element which is connected with a first end to the first flexible profile and with a second end to the second window frame profile, wherein the first flexible profile, the first thermally insulating connecting element and the second window frame profile are made of a second material.

In an embodiment of the window frame structure according to the invention, said second material is a flexible material, armoured or otherwise.

In an embodiment of the window frame structure according to the invention, the flexible material, armoured or otherwise, is a rubber.

In an embodiment of the window frame structure according to the invention, the at least first flexible profile and the at least first thermally insulating connecting element form an integrated whole. This means that the at least first flexible profile and the at least first thermally insulating connecting element are made of one piece of material or a combination of materials. In this case, the second window frame profile of the window frame structure is connectable to the aforementioned integrated whole by the end of the integrated whole being received in a fourth holder of the second window frame profile. It will be clear to the person skilled in the art that in this case the second window frame profile can comprise a different material or combination of materials, e.g. at least one of aluminium, an aluminium alloy and anodised aluminium, than the material or combination of materials that is used for the aforementioned integrated whole.

In an embodiment of the window frame structure according to the invention, the at least first thermally insulating connecting element and the at least second window frame profile form an integrated whole. This means that the at least first thermally insulating connecting element and the at least second window frame profile are made of one piece of material or a combination of materials. In this case, the first flexible profile of the window frame structure is connectable to the aforementioned integrated whole by a first connecting element of the first flexible profile being received in a sixth holder of the integrated whole. It will be clear to the person skilled in the art that in this case the first flexible profile can comprise a different material or combination of materials than the material or combination of materials that is used for the aforementioned integrated whole.

In an embodiment of the window frame structure according to the invention, the at least first flexible profile, the at least first thermally insulating connecting element and the at least second window frame profile form an integrated whole. This means that the at least first flexible profile, the at least first thermally insulating connecting element and the at least second window frame profile are made of one piece of material or a combination of materials.

According to an aspect of this invention, there is provided a connecting element for connecting together an at least first window frame structure and an at least second window frame structure of a window frame system according to the invention, wherein the connecting element comprises a first end which can be received in an at least first cavity of a thermally insulating connecting element of the at least first window frame structure, and a second end which can be received in an at least first cavity of a thermally insulating connecting element of the at least second window frame structure. The person skilled in the art will appreciate that the connecting element can for example be a corner connector or a T-profile. Any other suitable implementation of the connecting element according to the invention is of course also possible.

According to an aspect of this invention, there is provided a thermally insulating connecting element for use in at least one of a window frame system and a window frame structure according to the invention, wherein the thermally insulating connecting element comprises at least one of a bullet-proof material, a fire-resistant material and a sound-insulating material.

In an embodiment of the thermally insulating connecting element according to the invention, the thermally insulating connecting element comprises at least one of a biological material, a plastic, a composite material and a flexible material. By applying one of these materials or combination of these materials it is possible to provide thermally insulating connecting elements and window frame systems having at least one of bullet-proof, fire-resistant, sound-insulating and thermally insulating properties.

In an embodiment of the thermally insulating connecting element according to the invention, the flexible material comprises an armoured flexible material.

In an embodiment of the thermally insulating connecting element according to the invention, the thermally insulating connecting element comprises a fibre-reinforced material.

According to an aspect of this invention, there is provided a flexible profile for use in at least one of a window frame system according to the invention, wherein the flexible profile comprises at least a first and a second coupling element, which coupling elements comprise at least one corner with a radius smaller than 0.5 mm. In this way the flexible profile according to the invention can be received form-fitted in holders of the window frame profiles of the window frame system according to the invention. In this way the flexible profile is suitable for use in the window frame system according to the invention.

According to an aspect of this invention, there is provided a control system for opening or closing a window frame structure of a window frame system according to the invention, wherein the control system has at least a first motor for opening and/or closing a window frame structure, wherein the control system furthermore comprises at least one control unit configured for controlling the first motor. By integrating the control system according to the invention in a window frame system according to the invention for opening and closing window leaves/window frame structures of the window frame system it is possible to ensure a minimum width of the window frame profiles without this adversely affecting the visible width of the window frame profiles.

In an embodiment of the control system according to the invention, the control system is configured for autonomously opening and/or closing the first window frame structure depending on local environmental factors, such as $CO_2$ concentration, temperature and relative humidity of the ambient air. By using an autonomous control system according to the invention it is possible to regulate ventilation locally (per window frame, per room). No central control system is required, each control system according to the invention individually controls the respective window leaves in order to create the necessary ventilation. The ventilation can thus be regulated with great accuracy. If ventilation is required locally, ventilation is provided, and if no ventilation is required, no ventilation is provided. As a result, no unnecessary hot air is ventilated.

According to an aspect of this invention, there is provided a sun protection system for use in a window frame system according to the invention, wherein the sun protection system can be integrated with an at least first glass lath of the window frame system. By integrating a sun protection system according to the invention in an at least first glass lath it is possible to ensure a minimum width of the window frame profiles without this adversely affecting the visible width of the window frame profiles.

In an embodiment of the sun protection system according to the invention, the sun protection system comprises at least one of blinds and a screen.

BRIEF DESCRIPTION OF THE DRAWINGS

Although the invention will be described with reference to specific embodiments which are depicted diagrammatically in the enclosed figures, the invention is not restricted to the embodiments shown. The invention is described with reference to measures wherein explicit advantages may be cited, but wherein also implicit advantages may apply. The subject of the invention in the present application or in a divided application may each concern measures of which overall combinations are explicitly described and/or depicted in this description, but which may also be implicitly described. Although the enclosed figures show explicit combinations of measures according to the invention, it will be evident to the person skilled in the art that a number of these measures may also be taken separately from each other.

DETAILED DESCRIPTION OF THE PREFERRED EMBODIMENTS

Figure 1:
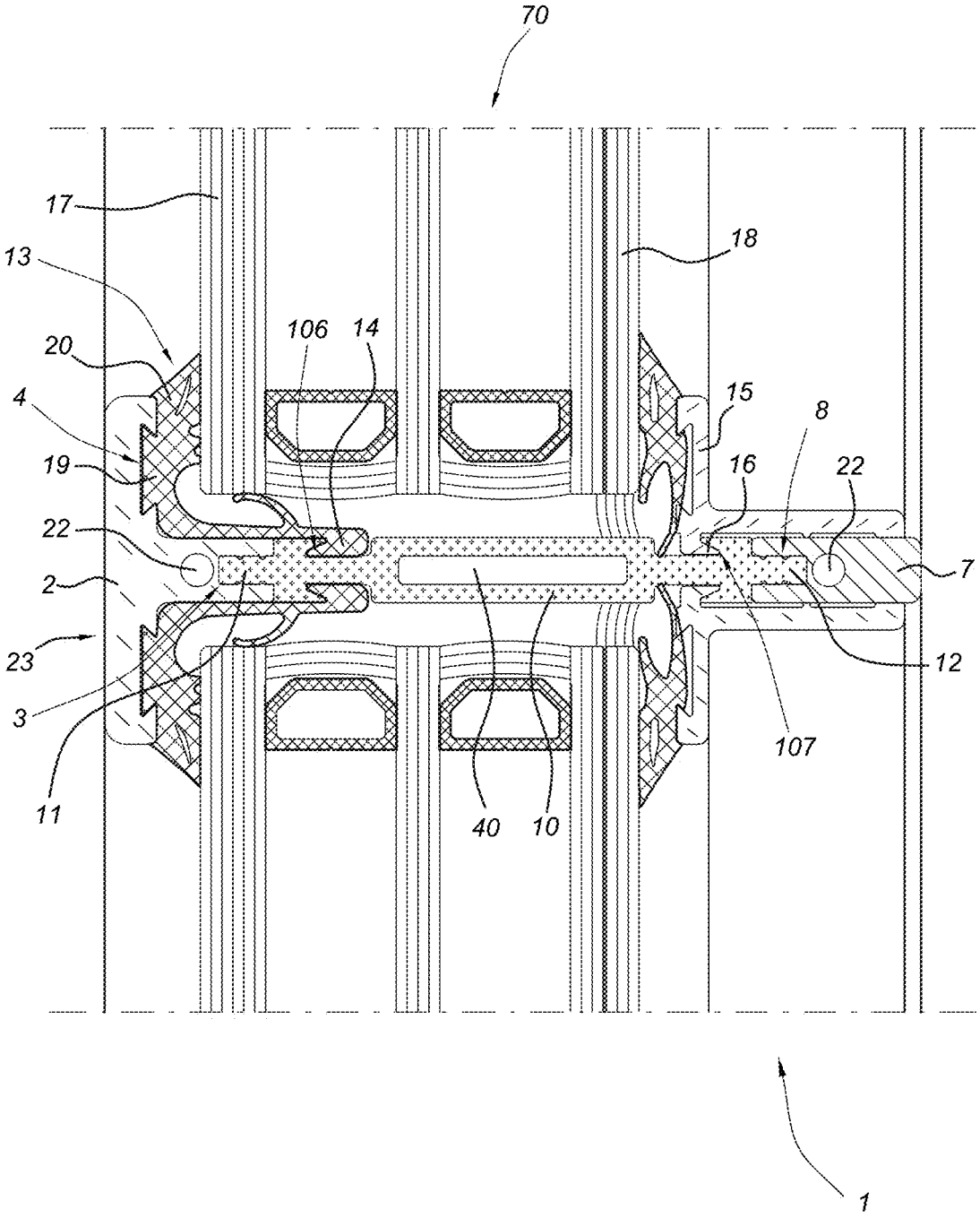
FIG. 1 shows a diagrammatic cross-section of an embodiment of a window frame system according to the invention.

The figures are not necessarily drawn to scale. Identical or similar components may be indicated with the same references in the different figures.

It will be evident to the person skilled in the art that the different aspects of the invention as described with reference to the enclosed figures may be used advantageously separately, but that these aspects may also be combined in any arbitrary advantageous manner. All conceivable combinations of the described aspects of the invention fall within the scope of protection of this invention.

The different aspects of the invention are aimed at producing window frame systems 1, such as window and door frames, with the smallest possible dimensions, at least in directions transverse to the longitudinal direction of the window frame structures from which the window frame system is constructed. A window frame system 1 according to the invention for a window or a door is for example constructed from four window frame structures which extend in pairs at right angles to each other, wherein ends of the window frame structures lying next to each other are connected together, preferably by means of a weld connection. This gives a window frame system 1 according to the invention wherein as little material as possible is used, as much light as possible can penetrate to the inside through the window and door frame, and more glass and/or more wall may be used which gives a better thermal insulation. The total thermal insulation of a window frame-glass-wall combination is better if the proportion of the most poorly insulating part, the window frame, is reduced.

Before discussing the above-mentioned figures in detail, a number of aspects of the invention will first be discussed.

Insulated Window Frame System Without Holders for Fittings and/or Profile-Widening Holders for Glass Laths This aspect of the invention relates to profiles of insulated window frame systems (steel, aluminium, plastic or wood). Insulated window frame systems (not steel) have specific holders for various components which are not assembled with or connected to the profiles, which make the profiles wider and hence reduce the insulation value of the total window frame system. By omitting these protruding holders from the system, the width of the profiles (insulated aluminium, plastic, composite, bio-composite, rubber) can be minimised, whereby the insulation value of the window frame can be improved.

Holder for Glass Lath for Window Frame Systems at Isolator

This aspect of the invention relates to the holder of the glass laths of insulated window frame systems (steel, aluminium etc.). Such window frame systems are suitable for windows or doors. For fixing panels or glazing in the window frame system, glass laths are attached to the second window frame profile after the panel or glazing has been placed in the window frame. These glass laths are fixed, in specific recesses/holders, to a shell part, the second window frame profile, of the assembled profile/window frame structure. However, by fixing these glass laths to a shell part, the second window frame profile, of the insulated profile/window frame structure, the depth of the isolator/thermally insulating element is limited to the location of the glass lath in the holder of the shell part. The depth of the isolator, i.e. the extension of the thermally insulating element in a direction perpendicular to the plates of a fitted panel, e.g. a glass panel, influences the insulation value of the window frame profile/window frame structure. The deeper the isolator/thermally insulating element, the better the insulation value. The relatively shallow isolator relatively limits the thermal insulation value of the window frame profile.

This aspect of the invention concerns the provision of an insulated window frame profile/window frame structure with holder for glass laths, wherein the holder is integrated in the isolator/thermally insulating element. In this way, the depth of the isolator is not limited to the location of the holder of the glass lath in the shell part which does not give good insulation. Therefore the isolator can allow the omission of a shell part. The window frame profile may thus consist of only two shell parts, namely the first (metal, e.g. aluminium) window frame profile and the thermally insulating element, instead of three, namely the first (metal, e.g. aluminium) window frame profile, the second (metal, e.g. aluminium) window frame profile and the thermally insulating element which connects the first and second window frame profiles together. Because the isolator is deeper, the insulation value of the profile/window frame structure is improved and hence also the insulation value of the total window frame.

Holder for Glazing Rubber for Window Frame Systems at Isolator

This aspect of the invention relates to the holder of the glazing rubber/first flexible profile of insulated window frame systems (steel, aluminium etc.). Such window frame systems are suitable for windows or doors. For sealing (air and water) of panels or glazing in window frame systems, glazing rubbers are attached to the window frame profile; the first flexible profile comprises a first sealing element which can be coupled to at least the first window frame profile and a first plate of a first panel which can be received in the window frame system. The glazing rubbers are attached, in specific recesses/holders, to a shell part of the assembled profile. However, by fixing these rubbers to a shell part of the insulated profile, the depth of the isolator is restricted to the location of the rubber in the holder of the shell part. The depth of the isolator/thermally insulating profile influences the insulation value of the window frame profile. The deeper the isolator/thermally insulating element, the better the insulation value. The relatively shallow isolator relatively limits the thermal insulation value of the window frame profile.

This aspect of the invention is oriented at the provision of an insulated window frame profile with holder for rubbers, wherein the holder is integrated in the isolator. The first flexible profile comprises at least a first and a second coupling element, which coupling element—which may or may not be form-fitted—can be received in respectively the second holder of the at least first window frame profile and the third holder of the at least first thermally insulating element. In this way, the depth of the isolator is not limited to the position of the holder of the rubber in the shell part which does not provide good insulation. The isolator may even allow the omission of a shell part, namely the second window frame profile. The window frame profile may thus consist of only two shell parts, namely the first (metal, e.g. aluminium) window frame profile and the thermally insulating element, instead of three, namely the first (metal, e.g. aluminium) window frame profile, the second (metal, e.g. aluminium) window frame profile and the thermally insulating element which connects the first and second window frame profiles together. Because the isolator is deeper, the insulation value of the profile/window frame structure is improved and hence also the insulation value of the complete window frame.

Rubber Holder for Window Frame Systems With Sharp Edges

This aspect of the invention relates to the holder of the seals (glazing, opening leaf, centre seal etc.) of window frame systems (steel, aluminium, plastic or wood). Such window frame systems are suitable for windows or doors. To make the window frame for a window or door airtight and watertight, usually soft plastic (EPDM, silicones, TPE etc.) seals are placed in specific recesses/holders. However, because the corners of these recesses are rounded, which is necessary for the application of a surface treatment, the dimensions of the recesses are relatively large. The minimum radius of corners for the correct application of a surface treatment is 0.5 mm. Due to the relatively large dimensions of these recesses, the overall window frame profile is relatively large. A panel of insulating glass supported by the window frame profiles has a better thermal insulation value than the metal insulated profiles. Due to the relatively wide aluminium profiles, the thermal insulation value of the window frame is relatively limited.

This aspect of the invention concerns the provision of a profile with holder for glass laths, wherein the dimensions of the holder are minimised with corners with a radius smaller than 0.5 mm. This does not take into account the minimum dimensions required for surface treatment. This is achieved in the window frame system according to the invention by using the holders in the system exclusively where no surface treatment is required. In this way, the dimensions of the window frame profile may be smaller than in window frame profiles already known. This may be advantageous for the total insulation value of the window frame and the quantity of material required/used for the window frame profiles.

Holder for Glass Lath for Window Frame Systems With Sharp Edges

This aspect of the invention concerns the holder for the glass laths (glazing, opening leaf, centre seal etc.) of window frame systems (steel, aluminium, plastic or wood). Such window frame systems are suitable for windows or doors. To fix panels or glazing in window frame systems, glass laths are attached to the window frame profile after the panel or glazing has been placed in the window frame. These glass laths are fixed into specific recesses/holders. However, because the corners of these recesses are rounded, which is necessary for the application of a surface treatment, the dimensions of the recesses are relatively large. The minimum radius of corners for the correct application of a surface treatment is 0.5 mm. Due to the relatively large dimensions of these recesses, the overall window frame profile is relatively large. A panel of insulating glass supported by the window frame profiles has a better thermal insulation value than the metal insulated profiles. Due to the relatively wide aluminium profiles, the thermal insulation value of the window frame is relatively limited.

This aspect of the invention concerns the provision of a profile with holder for glass laths, wherein the dimensions of the holder are minimised with corners with a radius smaller than 0.5 mm. This does not take into account the minimum dimensions required for surface treatment. This is achieved in the window frame system according to the invention by using the holders in the system exclusively where no surface treatment is required. In this way, the dimensions of the window frame profile may be smaller than in window frame profiles already known. This may be advantageous for the total insulation value of the window frame and the quantity of material required/used for the window frame profiles.

Holder for Glass Lath for Window Frame Systems at Fixing of Metal Half-Shell and Isolator This aspect of the invention concerns the holder for the glass laths (glazing, opening leaf, centre seal etc.) of insulated window frame systems (steel, aluminium, etc.). Such window frame systems are suitable for windows or doors. To fix panels or glazing in window frame systems, glass laths are attached to the window frame profile after the panel or glazing has been placed in the window frame. These glass laths are fixed into specific recesses/holders. However, by creating a non-integrated holder on the profile, the dimensions of the profile are relatively large. A panel of insulating glass supported by the window frame profiles has a better thermal insulation value than the metal insulated profiles. Due to the relatively wide aluminium profiles, the thermal insulation value of the window frame is relatively limited.

This aspect of the invention concerns the provision of a profile with holder for glass laths, wherein the holder is integrated with the holder for the isolator. In this way, the dimensions of the window frame profile may be smaller than in window frame profiles already known. This may be advantageous for the total insulation value of the window frame and the quantity of material required/used for the window frame profiles.

Glued Fixing of Isolator in Half-Shells

This aspect of the invention relates to the fixing of the isolator (composite, plastic) of insulated window frame systems (steel, aluminium etc.). Such window frame systems are suitable for windows or doors. For the thermal interruption of the relatively highly conductive metal (aluminium, steel etc.) profiles, the outer shell is connected to the inner shell by means of one or more isolators, a part with poor thermal conduction (composite, plastic etc.). For this, the isolator is clamped in a holder on both shell parts of the profile. The feet of the holder are clamped; bent over the length of the profile or repeatedly compressed. However, by the creation of a clamping holder, the dimensions of the profile are relatively large. The holder of the metal half-shell must namely either be pressed over a widened end of the isolator, or the holder of the half-shell must be made of such thick material that it can be pressed into the isolator. A panel of insulating glass supported by the window frame profiles has a better thermal insulation value than the metal insulated profiles. Due to the relatively wide aluminium profiles, the thermal insulation value of the window frame is relatively limited.

This aspect of the invention concerns the provision of a fixing of the isolator to the metal half-shells, wherein the isolator is glued in the holders of the half-shells. In this way the dimensions of the isolator and the holders of the half-shells and hence the window frame profile may be smaller than in window frame profiles already known. This may be advantageous for the total insulation value of the window frame and the quantity of material required/used for the window frame profiles.

Hollow Isolator

This aspect of the invention relates to the isolator (composite, plastic etc.) of insulated window frame systems (steel, aluminium etc.). Such window frame systems are suitable for windows or doors. For the thermal interruption of the relatively highly conductive metal (aluminium, steel etc.) profiles, the outer shell is connected to the inner shell by means of one or more isolators, a part with poor thermal conduction (composite, plastic etc.). If a single isolator is used in the profile, this must be able to transmit the whole of the mechanical force between the two shell parts of the profile. For this, the isolator must be dimensioned sufficiently wide. The heat transmission between the two shell parts of the profile takes place via the thermal conduction of the isolator. The wider the isolator, the easier/the more heat can be conducted by the isolator and hence by the assembled profile.

This aspect of the invention concerns the provision of a hollow isolator for insulated window frame systems, wherein the heat transmission through the profile is limited but the mechanical properties remain as high as possible. In this way, the insulation value and strength of the assembled window frame profile is as high as possible. This may be advantageous for the total insulation value of the window frame and the quantity of material required/used for the window frame profiles.

Outer Seal With Integrated Centre Seal

This aspect of the invention relates to the seal (glazing seal, seal against building etc.) of insulated window frame systems (steel, aluminium etc.). Such window frame systems are suitable for windows or doors. For sealing the glazing and panels received in the window frame profiles, and to seal the window frame to the building frame, a seal is received in the window frame on the outside. This seal serves to close the system as water-tightly and air-tightly as possible. By now integrating a second seal in this rubber, it is possible to discharge water which may still pass the first seal via the compartment created in this way before it actually reaches the interior. The second seal in addition ensures an extra air-tightness of the system. The air pressure differences between interior and exterior are further compartmentalised, whereby the first (outermost) compartment can be drained more easily towards the outside.

System for Controlled Opening of Window Leaves Integrated in System Behind the Post of the Window Leaf To ensure a minimum width of the window frame profiles, the system for opening and closing window leaves/window frame structures should also be integrated in the window frame system without this adversely affecting the width of the profiles.

This aspect of the invention concerns an opening system/control system which is integrated in the window leaf. The control system comprises a motor which can be coupled to at least one of the window frame profiles of the window leaf/window frame structure, and a control unit which is configured for controlling the motor which can open and close the window leaf. The motor may be installed behind a post/upright of the window leaf or may be integrated in a glass lath.

System for Controlled Opening of Window Leaves Integrated in the Glass Lath

To ensure a minimum width of the window frame profiles, the system for opening and closing window leaves/window frame structures should also be integrated in the window frame system without this adversely affecting the width of the profiles.

This aspect of the invention concerns an opening system/control system which is integrated in the glass lath.

Window Leaf Suspension and Closure Fittings Integrated in the Glass Lath

To provide a minimum width of the window frame profiles, the suspension and closure fitting for opening and closing the window leaves should also be integrated in the window frame system, without this adversely affecting the width of the profiles. The window leaves/window frame structures comprise fixing elements for connecting the window leaves to the window frame system. Furthermore, the fixing elements are configured for transferring the window leaves from a first closed state to a second, at least partially open state. The window leaves furthermore comprise locking mechanisms/locks for locking and unlocking the window leaves of the window frame system. This aspect of the invention concerns suspension and closure fittings which are integrated in the glass lath. This means that in one embodiment of the window frame system according to the invention, the fixing elements and/or the locking mechanisms of the window leaves may be integrated in the glass lath. The fixing element may be a hinge which can be integrated in the glass lath. The locking mechanisms may be locks which can be integrated in the glass lath.

Sun Protection (Screen, Blinds) Integrated in the Glass Lath

To ensure a minimum width of the window frame profiles, the sun protection should be integrated in the window frame system. This aspect of the invention concerns a sun protection which is integrated in the glass laths.

Function-/Performance-Determining Composite Isolator

This aspect of the invention concerns the isolator (plastic, composite etc.) of insulated window frame systems (steel, aluminium etc.). Such window frame systems are suitable for windows or doors. By minimising the profiles completely (omitting the protruding holders and making the half-shells solid) and by minimising the peripheral play around the glass, it is possible to determine the desired specifications of the window frame system by changing the composition of the isolator.

For bullet-proof window frame systems, the glass must be bullet-proof, the peripheral play around the glass must be smaller than the diameter of the bullet, and the isolator intended for this function must have a bullet-proof composition.

For fire-resistant window frame systems, the glass must be fire-resistant, the peripheral play filled with fire-resistant material (tape, film, paint etc.) and the isolator intended for this function must have a fire-resistant composition.

For sound-insulating window frame systems, the glass must be sound-insulating, the peripheral play around the glass filled with a sound-insulating material, and the isolator intended for this function must have a sound-insulating composition.

For thermally insulating window frame systems, the glass must offer good thermal insulation, the peripheral play must be filled with a material with good thermal insulation or stationary air, and the isolator intended for this function must have good thermal insulation.

Transparent Window Frame System

By making the window frame profiles transparent, the quantity of light which enters is maximised. For this, the required window frame dimension must be minimised in order to allow sufficient daylight in the room. A smaller window frame may suffice, whereby a wall with better insulation may be used instead.

Autonomous Control System for Opening/Closing Individual Window Leaves on the Basis of Individual Ventilation Needs This aspect of the invention concerns an autonomously functioning control system which opens or closes the window leaf according to local needs ($CO_2$ concentration, temperature, relative humidity or other factors).

This autonomous control system controls the ventilation locally (per window frame, per room). No central control system is required; each control system individually controls the respective window leaves in order to create the required ventilation. The ventilation can thus be regulated highly accurately. If local ventilation is required, ventilation is provided, and if no ventilation is required, no ventilation is provided. In this way, no heat is wasted unnecessarily.

Mastic-Compatible Glazing Seal

This aspect of the invention concerns glazing seals (the seal for glazing and panels) which are formed such that a wet glazing seal or mastic can be applied. This seal allows the glazing to be applied with hook-mounted or click-fit glass laths, after which a wet seal is applied by means of mastic.

Two-Part Glass Lath

This aspect of the invention concerns the glass lath (metal, plastic, composite etc.) of insulated window frame systems (steel, aluminium, plastic, composite etc.).

Such window frame systems are suitable for windows or doors. This aspect of the invention concerns glass laths made of two parts, a lower part and a second upper part. In this way it is possible to determine the finish of the glass laths by means of the second upper part. This finish may be applied, modified or renewed while the window frame is already glazed and remains glazed.

Co-Extrudable Glass Lath

This aspect of the invention concerns a window frame system in which the surface finish of the glass laths is applied in a line with the extrusion or pultrusion of the glass laths.

Co-Extrudable Window Frame System

This aspect of the invention concerns a window frame system in which the surface finish of the window frame profiles is applied in a line with the extrusion or pultrusion of the profiles.

According to further aspects of the invention, window frame systems and isolators are provided which comprise biological material.

FIG. 1 shows a diagrammatic cross-section of an embodiment of a window frame system 1 according to the invention for fixing of at least a first panel 70. The window frame system 1 comprises a first window frame structure 23 which has a first window frame profile 2. The first window frame profile 2 is provided with a first holder 3 and a second holder 4. In the embodiment shown on FIG. 1, the first window frame structure 23 furthermore comprises a first thermally insulating element 10 which has a first end 11 and a second end 12, wherein the first end 11 is received in the first holder 3 of the first window frame profile 2, and the second end 12 is received in a fourth holder 8 of a second window frame profile 7. In this way, the first window frame profile 2 and the second window frame profile 7 are connected together in a thermally insulated fashion. The connection between the first end 11 and the first holder 3 firstly, and between the second end 12 and the fourth holder 8 secondly, may be achieved by at least one of an adhesive connection and a mechanical connection, or at least one of a punch connection, a clamp connection, a rivet connection, a push-fit connection and a screw connection. The use of said connecting methods has the advantage that in this way, the dimensions of the first thermally insulating element 10, the first holder 3 and the fourth holder 8, and hence of the first window frame structure 23, may be smaller than in known window frame structures. This may be advantageous for the total insulation value of the window frame system 1 and the quantity of material required/used for the window frame system 1.

In the embodiment shown in FIG. 1, the thermally insulating element 10 is provided with a sixth holder 106 and a seventh holder 107. The sixth holder 106 is oriented towards the second end 12, and the seventh holder 107 is oriented towards the first end 11 of the first thermally insulating element 10. Furthermore, the first window frame structure 23 comprises a first flexible profile 13 comprising a first sealing element 20 which is coupled to the first window frame profile 2 and a first plate 17 of the first panel 70 which is received in the window frame system 1 according to the invention. The first window frame structure 23 furthermore comprises a first glass lath 15 which is coupled to a second plate 18 of the first panel 70 and the first thermally insulating element 10. The second holder 4 of the first window frame profile 2 and the sixth holder 106 and the seventh holder 107 of the first thermally insulating element 10 comprise at least one internal corner with a radius which is smaller than 0.5 mm. By using holders with internal corners which have a radius smaller than 0.5 mm, there is no need to take account of minimum dimensions required for surface treatment. In the window frame system 1 according to the invention, this is achieved by using the holders in the system only where no surface treatment is necessary. In this way, the dimensions of the window frame profile may be smaller than in window frame profiles already known. This may be advantageous for the total insulation value of the window frame and the quantity of material required/used for the window frame profiles.

FIG. 1 furthermore shows that the first flexible profile 13 furthermore comprises a first coupling element 14 and a second coupling element 19, wherein the first coupling element 14 is received in the second holder 4 of the first window frame profile 2, and the second coupling element 19 is received in the sixth holder 106 of the first thermally insulating element 10. In the embodiment of the window frame system 1 as shown in FIG. 1, the first glass lath 15 comprises a third coupling element 16 which is received in the seventh holder 107 of the first thermally insulating element 10.

FIG. 1 furthermore shows that the first window frame profile 2 and the second window frame profile 7 are provided with a first cavity 22, which forms an open passage between a first side and a second side of the respective window frame profile 2, 7. The cavity 22 may have the function of a screw channel which allows the window frame profiles, positioned at right angles to each other, to be connected together by means of at least one screw connection.

In the embodiment of the window frame system shown in FIG. 1, the first thermally insulating element 10 is an elongated strip which is provided with a cavity 40. In this way, it is possible to limit the heat transfer through the window frame profiles while the mechanical properties remain as high as possible. Furthermore, in this way, it is possible to make the insulation value and strength of the assembled window frame profiles as high as possible. The first thermally insulating element 10 may comprise at least one of a bullet-proof material, a fire-resistant material and a sound-insulating material. A material with at least one of said properties may be at least one of a biological material, a composite material, a plastic, a fibre-reinforced material and a flexible material. The flexible material may comprise an armoured flexible material. It will be evident to the person skilled in the art that the use of at least one of these materials or combinations thereof allows numerous construction and/or integration possibilities for creating the window frame structures and window frames systems according to the invention. It will be clear to the person skilled in the art that the entire window frame system 1 according to the invention may be made from at least one of the above-mentioned materials with at least one of the above-mentioned properties.

Figure 2:
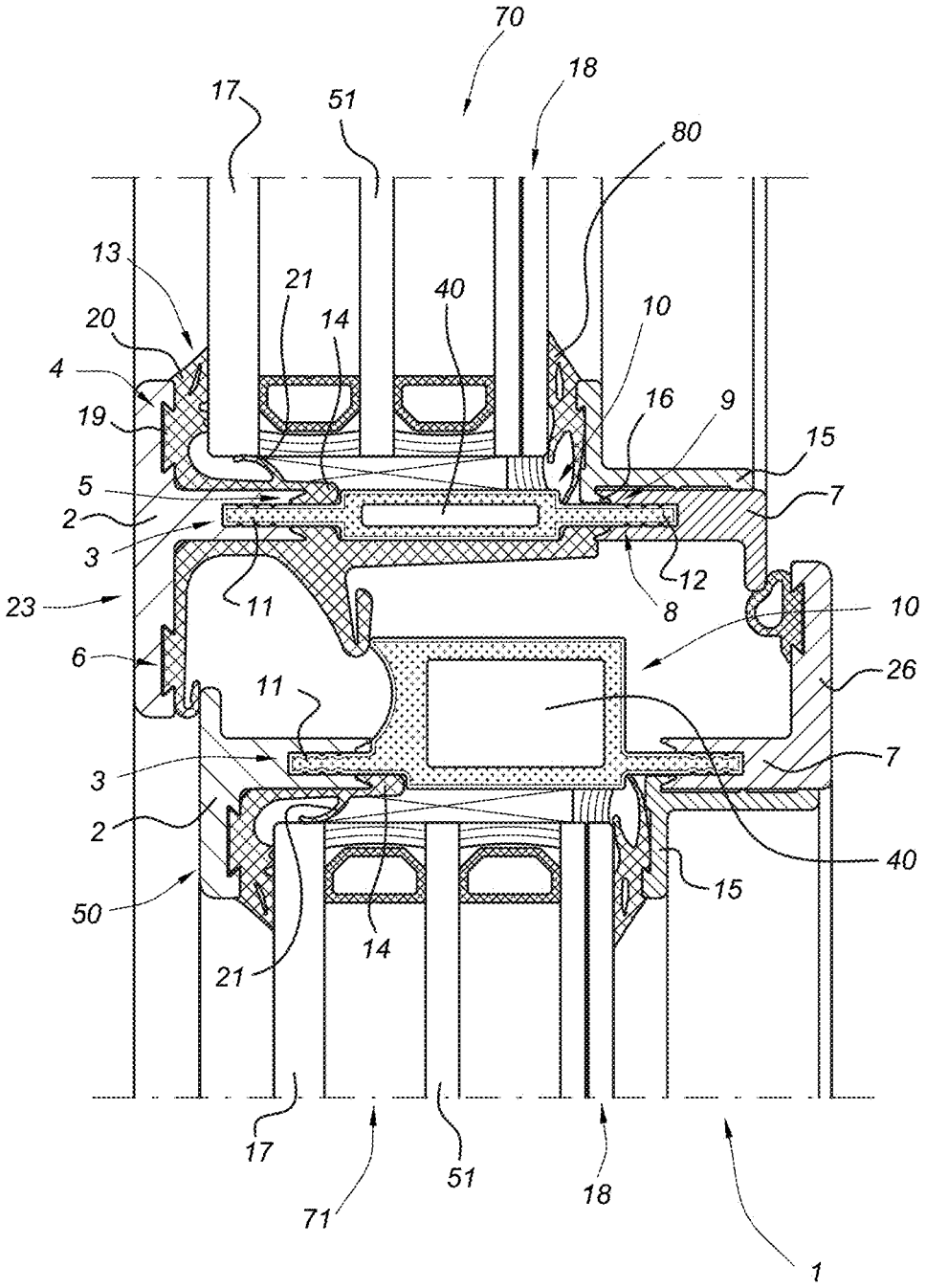
FIG. 2 shows a diagrammatic cross-section of exemplary embodiments of two window frame structures of a window frame system according to the invention.

FIG. 2 shows a diagrammatic cross-section of exemplary embodiments of two window frame structures 23, 50 of a window frame system 1 according to the invention for the fixing of a panel. The first window frame structure 23 is connected to a first panel 70. In the example of FIG. 2, the first panel 70 comprises an assembly of a first 17, a second 18 and a third glass plate 51. The second window frame structure 50 is connected to a second panel 71 which, in the example of FIG. 2, is also an assembly of a first 17, a second 18 and a third glass plate 51. It will be clear to the person skilled in the art that the second panel 71 may be any other desired type of panel.

FIG. 2 furthermore shows that the first window frame structure 23 comprises a first window frame profile 2 which is provided with a first 3, a second 4 and a third holder 5. Furthermore, the first window frame structure 23 comprises a second window frame profile 7 which is provided with a fourth 8 and a fifth holder 9. The first window frame profile 2 and the second window frame profile 7 are positioned relative to each other such that the first 3, the second 4 and the third 5 holders of the first window frame profile 2 are oriented towards the fourth 8 and the fifth 9 holders of the second window frame profile 7. The first window frame structure 23 furthermore comprises a thermally insulating connecting element 10 which comprises a first end 11 and a second end 12. The first end 11 of the thermally insulating element 10 is received in the first holder 3 of the first window frame profile 2. The second end 12 is received in the fourth holder 8 of the second window frame profile 7, for connecting together the first 2 and the second 7 window frame profiles.

FIG. 2 furthermore shows that the first window frame structure 23 comprises a flexible profile 13 which comprises a sealing element 20 positioned in lying contact with the first window frame profile 2 and the first glass plate 17 of the first panel 70. The flexible profile 13 forms an external sealing rubber for closing the window frame system to a building frame as water-tightly and air-tightly as possible. The flexible profile 13 furthermore comprises a first coupling element 14 and the second coupling element 19 which are received by form-fit in respectively the third holder 5 and the second holder 4 of the first window frame profile 2 of the first window frame structure 23.

FIG. 2 furthermore shows that the first window frame structure 23 comprises a glass lath 15 containing a third coupling element 16 which is received by form-fit in the fifth holder 9 of the second window frame profile 7. The glass lath 15 is applied after the first panel 70 has been positioned and is connected to the second glass plate 18 of the first panel 70 via an internal sealing rubber 80.

The second 4 and the third 5 holders of the first window frame profile 2, and the fifth holder 8 of the second window frame profile 7, comprise an internal corner with a radius which is smaller than 0.5 mm. The second window frame structure 50 is constructed in a similar manner to the first window frame structure 23, with the difference that the first 2 and the second 7 window frame profiles and the thermally insulating connecting element 10 of the first window frame structure 23 have a different shape from the first 2 and the second 7 window frame profiles and the thermally insulating connecting element 10 of the second window frame structure 50.

For producing an airtight and watertight window frame system for a window or a door, comprising at least one of the materials steel, aluminium, plastic or wood, normally seals are used, namely external or glazing seals, opening leaf seals, centre seals and internal seals, which comprise a soft plastic such as for example ethylene-propylene-diene monomer (EPDM), silicones and thermoplastic elastomers (TPE). These seals are placed in specifically provided recesses or holders 4, 5, 9. However, because the corners of these holders are usually rounded, which is necessary for the application of a surface treatment, the dimensions of these holders are relatively large. The minimum radius of corners for the correct application of a surface treatment is 0.5 mm. Due to the relatively large dimensions of these recesses, the total window frame profile is relatively large. A panel of insulating glass supported by window frame structures has a better thermal insulation value than the metal insulated window frame structures. Due to the relatively wide aluminium profiles, the thermal insulation value of the window frame is however relatively limited.

By using holders 4, 5, 9 with internal corners which have a radius smaller than 0.5 mm, no account is taken of the minimum dimensions of holders which are required if the window frame profiles are provided with a surface treatment. In the case of the window frame system 1 according to the invention, this is also not required since the holders for seals, such as the holders 4, 5, 9 of the first 2 and second 7 window frame profiles, are used exclusively where no surface treatment of the window frame profiles 2, 7 is necessary. Since the holders 4, 5, 9 do not widen the profile, the dimensions of the window frame profiles 2, 7 may be smaller than in window frame profiles known from the prior art. This may be advantageous for the total insulation value of the window frame system 1 and for the quantity of material required or used for the window frame profiles 2, 7.

For the fixing of panels or glazing in window frame systems, glass laths are attached to the window frame profile after the panel or glazing has been placed in the window frame system. These glass laths are attached in recesses/holders provided for this. As shown in FIG. 2, the third coupling element 16 of the glass lath 15 is received in the fifth holder 9 of the second window frame profile 7 of the first window frame structure 23. The glass lath 15 is connected to the second glass plate 18 of the first panel 70 via an internal sealing rubber 80. In this way, the first panel 70 is held in place in the window frame system 1. However the corners of the holders for fixing the glass laths are usually rounded in conventional window frame systems and have a minimum radius of 0.5 mm. As already stated above, a minimum radius of 0.5 mm is required for the uniform application of a surface treatment. Because of this minimum radius of the corners of the holders for the glass laths, the dimensions of these holders are relatively large. Thus the dimensions of window frame profiles are relatively large, at least in directions transverse to the length direction of the window frame structures of conventional window frame systems. A panel of insulating glass supported by window frame structures has a better thermal insulation value than the metal insulated window frame structures. Due to the relatively wide aluminium profiles, the thermal insulation value of a conventional window frame system is relatively limited because the surface area of the glass panels offering better insulation is smaller than it might be.

By using holders for glass laths, such as holder 9 of the second window frame profile 7, wherein these holders have an internal corner which has a radius smaller than 0.5 mm, no account is taken of the minimum dimensions of holders which are required if the window frame profiles are provided with a surface treatment. In the case of the window frame system 1 according to the invention, this is also not required since the holders for glass laths, such as the holder 9, are used exclusively where no surface treatment of the window frame profiles 2, 7 is necessary. Since the holders for glass laths, such as holder 9, do not widen the profile, the dimensions of the window frame profiles 2, 7 may be smaller than in window frame profiles known from the prior art. This may be advantageous for the total insulation value of the window frame system 1 and for the quantity of material required or used for the window frame profiles 2, 7 and hence for the window frame structures 23, 50.

FIG. 2 shows that the first holder 3 which receives the first end 11 of the thermally insulating connecting element 10, and the third holder 5 which receives the first coupling element 14 of the flexible profile 13, are integrated. FIG. 2 also shows that the fourth holder 8 which receives the second end 12 of the thermally insulating connecting element 10, and the fifth holder 9 which receives the third coupling element 16 of the glass lath 15, are integrated. By integrating the holders for the thermally insulating connecting element and the glass laths, the dimensions of the first 2 and second 7 window frame profiles may be smaller than in window frame profiles known from the prior art. This may be advantageous for the total insulation value of the window frame system 1 and for the quantity of material required or used for the window frame profiles 2, 7 and hence for the window frame structures 23, 50.

For the thermal interruption of the relatively highly conductive metal window frame profiles of a window frame structure of the window frame systems known in the prior art, the window frame profiles of which comprise for example aluminium or steel, the window frame profiles are connected via one or more elements with poor thermal conduction, comprising a composite or plastic. For this, a thermally insulating element is clamped in holders provided for this and aligned on both metal window frame profiles of the window frame structure. The holders, i.e. the edges of a receiver space of the holders concerned, are clamped i.e. bent over a length of the thermally insulating element over which the thermally insulating element extends into the holder. Another possibility is that the edges of the holder are compressed at repeated intervals over said length of the thermally insulating element. However by creating such clamping holders, the dimensions of the thermally insulating profile become relatively large. In a known embodiment, the holders of the metal window frame profiles, also known as metal half-shells are pressed over a widened end of the isolator. According to another known embodiment, the holders may comprise protruding parts which are dimensioned, i.e. made of a thick material, such that they can be pressed into the thermal isolator. As already stated above, a panel of insulating glass supported by window frame structures has a better thermal insulation value than the metal insulated window frame structures. Due to the relatively wide aluminium profiles, the thermal insulation value of the window frame system is relatively limited.

In an embodiment of the window frame structures 23, 50 according to the invention, the first end 11 of the thermally insulating connecting element 10 is connected to the first holder 3 of the first window frame profile 2 by means of an adhesive connection. The second end 12 of the thermally insulating connecting element 10 is also connected to the fourth holder 8 of the second window frame profile 7 by means of an adhesive connection. In this way, the dimensions of the thermally insulating connecting element 10, the first holder 3 and the fourth holder 8 can be reduced relative to a holder known from the prior art. Consequently, the dimensions of the first 2 and second 7 window frame profiles may be smaller than in window frame profiles known from the prior art. This may be advantageous for the total insulation value of the window frame system 1 and for the quantity of material required or used for the window frame profiles 2, 7 and hence for the window frame structures 23, 50.

In another embodiment of the window frame structures 23, 50, the thermally insulating connecting element 10 may be configured such that it can be connected by means of an adhesive connection and/or a mechanical connection to the first holder 3 of the first window frame profile 2. The mechanical connection may be at least one of a punch connection, a clamp connection, a rivet connection, a push-fit connection and a screw connection.

As already described above, for the thermal interruption of the relatively highly conductive metal window frame profiles of a window frame structure of the window frame systems known from the prior art, in which the window frame profiles comprise for example aluminium or steel, the window frame profiles are connected via one or more elements offering poor thermal insulation, comprising a composite or plastic. If a single thermally insulating connecting element is used in the window frame structure, this must be able to transfer the whole of the mechanical force between the two window frame profiles of the window frame structure. For this, the single thermally insulating connecting element must be dimensioned sufficiently wide. The heat transfer between the two metal window frame profiles of the window frame structure takes place via thermal conduction of the single thermally insulating connecting element. The wider this thermally insulating connecting element, the more heat or the easier the heat is conducted by the thermally insulating connecting element and hence by the window frame structure as a whole.

In an embodiment of the window frame system 1 as shown in FIG. 2, the thermally insulating connecting element 10 is provided with a cavity 40. It will be evident to the person skilled in the art that the thermally insulating connecting element 10 may be provided with more than one cavity 40. By providing the thermally insulating connecting element 10 with a cavity 40, the heat transfer through a window frame structure 23, 50 according to the invention may be limited, while the mechanical properties remain as high as possible. In this way, the insulation value and strength of the window frame structures 23, 50 according to the invention are as high as possible. This may be advantageous for the total insulation value of the window frame system 1 and for the quantity of material required or used for the window frame profiles 2, 7 and hence for the window frame structures 23, 50.

Figure 3:
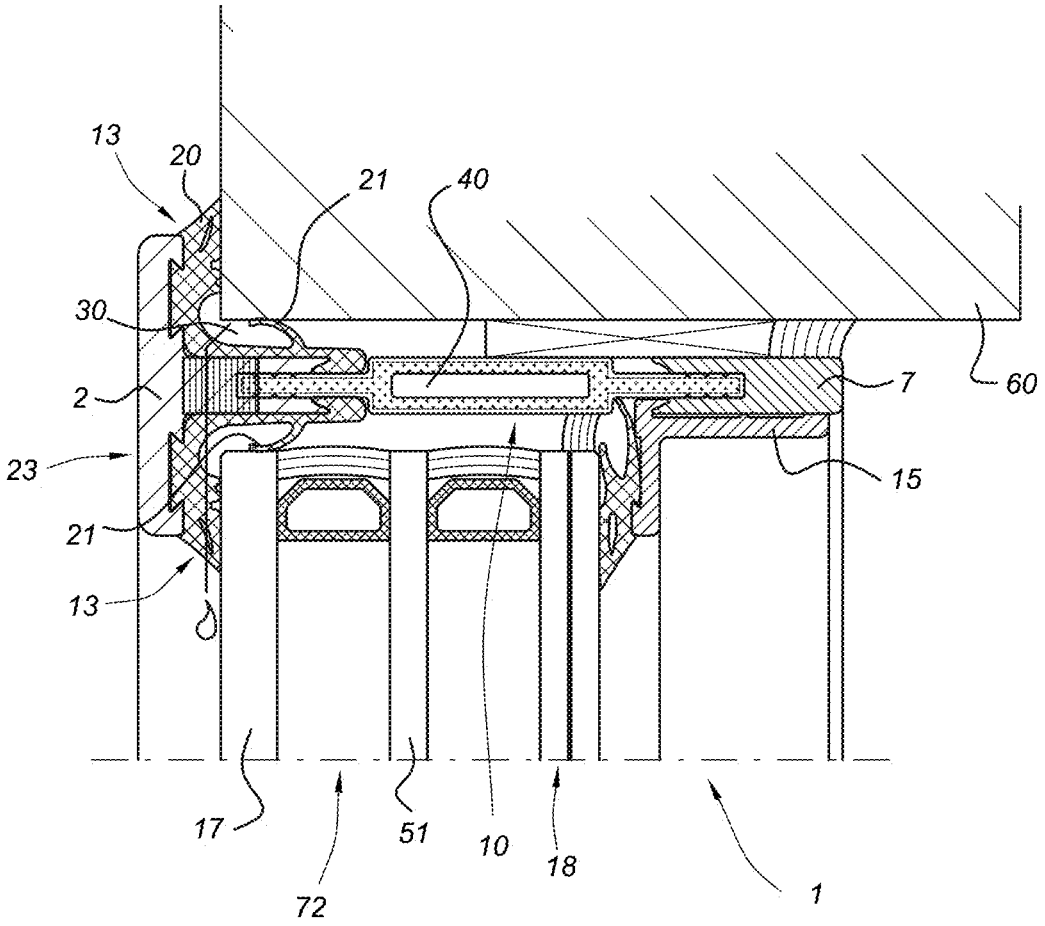
FIG. 3 shows a diagrammatic cross-section of a further exemplary embodiment of a window frame structure of a window frame system according to the invention.

As already described above, in the window frame system 1 according to the invention, flexible profiles 13 are used as an external sealing rubber for closing the window frame system to a building frame as water-tightly and air-tightly as possible. FIG. 3 shows a diagrammatic cross-section of a further exemplary embodiment of a window frame structure 23 according to the invention which comprises two flexible profiles 13, each of which has a second sealing element 21. The second sealing element 21 of the first flexible profile 13 is positioned in lying contact with the first window frame profile 2 and the first glass plate 17 of an insulating panel 72. The second sealing element 21 of the second flexible profile 13 is positioned in lying contact with the first window frame profile 2 and a wall 60.

FIG. 3 furthermore shows that the first 20 and second 21 sealing elements of the flexible profile 13 form a first channel 30 for the discharge of a fluid, for example water, which has penetrated past the first sealing element 20 during use of the window frame system 1. By integrating the second sealing element 21, which serves as a centre seal, with the flexible profile 13, the channel 30 is produced which is limited by the first sealing element 20, the second sealing element 21 and the wall 60. In this way, the water which penetrates past the first sealing element 20 can be captured in the channel 30 and discharged to the outside before it actually penetrates the building frame. The second sealing element 21 in addition ensures an extra airtightness of the window frame system 1. The air pressure differences between interior and exterior are compartmentalised further, whereby the first (outermost) channel/compartment 30 can be drained towards the outside more easily.

Figure 4A:
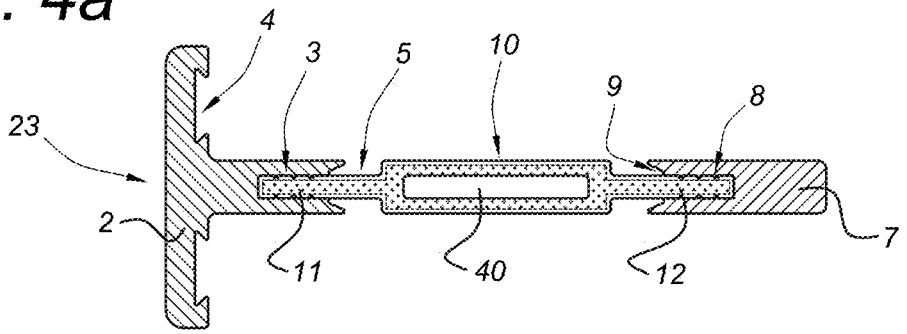
FIG. 4*a* shows a diagrammatic cross-section of the embodiment of the window frame structure according to the invention as shown in FIG. 3.

Insulated window frame systems (not steel) have specific protruding holders for various components which are assembled or connected to the window frame structures, such as fittings and/or glass laths, whereby the window frame structures become wider and adversely affect the insulation value of the total window frame system. By omitting these protruding holders from the window frame system, the window frame structures (insulated aluminium, plastic, composite, bio-composite, rubber) are minimised in directions transverse to the length direction of the window frame structure 23, such as for example the width of the window frame structure 23. In this way, the insulation value of the window frame system, in which the window frame structure 23 is used, can be improved. FIG. 4*a* shows a diagrammatic cross-section of an embodiment of the window frame structure 23 as shown in FIG. 3. The window frame structure 23 shown diagrammatically in FIG. 4*a* comprises first 2 and second 7 window frame profiles which consist of a metal, for example at least one of aluminium, an aluminium alloy, anodised aluminium and steel. The first 2 and second 7 window frame profiles are connected via a thermally insulating connecting element 10 which comprises a first end 11 and the second end 12. The first end 11 of the thermally insulating element 10 is received in the first holder 3 of the first window frame profile 2. The second end 12 is received in the fourth holder 8 of the second window frame profile 7.

FIG. 4*a* furthermore shows that the first window frame profile 2 of the embodiment of the window frame structure 23 is provided with a second 4 and a third holder 5 which form integrated holders for a flexible profile 13 which forms an external sealing rubber for closing a window frame system 1 according to the invention against a building frame as water-tightly and air-tightly as possible. As shown in FIGS. 2 and 3, the flexible profile 13 comprises first 14 and second 19 coupling elements which may be received by form-fit in respectively the third holder 5 and the second holder 4.

FIG. 4*a* furthermore shows that the second window frame profile 7 of the embodiment of the window frame structure 23 is provided with a fifth holder 9 which forms an integrated holder for a glass lath 15. As shown in FIGS. 2 and 3, the glass lath 15 comprises a third coupling element 16 which may be received by form-fit in the fifth holder 9 of the second window frame profile 7. It will be clear to the person skilled in the art that the window frame structure 23 as shown in FIG. 4*a* is fully minimised by making the window frame profiles 2, 7 solid and omitting protruding, profile-widening holders, for example for fittings and/or glass laths according to the prior art, and instead creating the integrated holders 4, 5, 9 described above.

In one embodiment of the window frame structure 23 as shown in FIG. 4*a*, the thermally insulating connecting element 10 is provided with a cavity 40. It will be clear to the person skilled in the art that the thermally insulating connecting element 10 may be provided with more than one cavity 40. By providing the thermally insulating connecting element 10 with a cavity 40, the heat transfer through a window frame structure 23, 50 according to the invention can be limited while the mechanical properties remain as high as possible. In this way, the insulation value and strength of the window frame structures 23, 50 according to the invention are as high as possible. This may be advantageous for the total insulation value of the window frame system 1 and for the quantity of material required or used for the window frame profiles 2, 7 and hence for the window frame structures 23, 50.

As already described, embodiments of the window frame system according to the invention are possible in which the window frame system comprises at least one of a biological material, a plastic, a composite material and a flexible material. By using one of these materials or a combination of these materials, it is possible to create window frame systems which have at least one of bullet-proof, fire-resistant, sound-insulating and thermally insulating properties. Furthermore, it is possible that the first window frame profile, the thermally insulating connecting element and second window frame profile are integrated by making these from the same material. In this way, a thermally insulated window frame structure may be produced from at least one of for example a plastic, a biological material, a composite, a bio-composite and a flexible material. It will be evident to the person skilled in the art that a number of possible materials and combinations of materials are possible within the concept of the invention. It will also be clear that the use of these materials and material combinations offers numerous construction and/or integration possibilities for creating window frame structures and window frame systems according to the invention. It is for example possible to make the first window frame profile 2 and the second window frame profile 7 of at least one of aluminium, an aluminium alloy and anodised aluminium. The first thermally insulating connecting element 10, as already described above, may comprise at least one of a biological material, a plastic, a composite material, a bio-composite material and a flexible material.

Although not shown, in one embodiment of at least one of the window frame system and window frame structure according to the invention, the at least first window frame profile 2 and the at least first thermally insulating connecting element 10 may form an integrated whole, i.e. be made of one piece. In this case, the second window frame profile 7 may be connected to the integrated whole by the end 12 of the whole being received in the fourth holder 8 of the second window frame profile 7.

Although also not shown, the person skilled in the art will understand that, similarly, it is possible that according to one embodiment of at least one of the window frame system and window frame structure according to the invention, the at least first thermally insulating connecting element 10 and the least second window frame profile 7 may form an integrated whole. In this case, the first window frame profile 2 may be connected to the integrated whole by the end 11 of the whole being received in the first holder 3 of the first window frame profile 2.

Figure 4B:
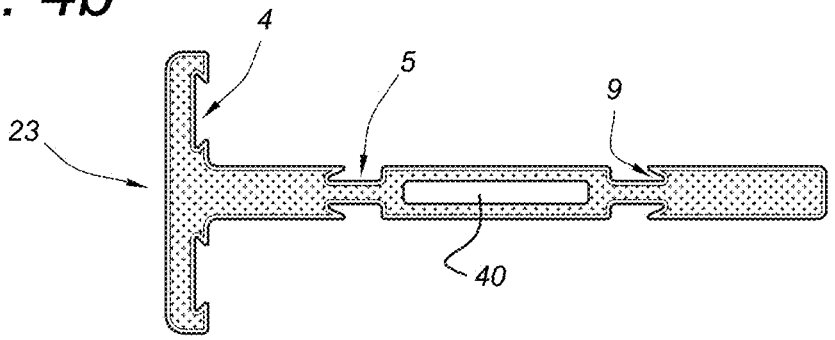
FIG. 4*b* shows a diagrammatic cross-section of another exemplary embodiment of a window frame structure according to the invention.

FIG. 4*b* shows a diagrammatic cross-section of another exemplary embodiment of a window frame structure 23 according to the invention, in which the first window frame profile 2, the thermally insulating connecting element 10 and the second window frame profile 7, as shown in FIGS. 2, 3 and 4*a*, are integrated by being made of the same material. In the embodiment of the window frame structure 23 shown in FIG. 4*b*, the first window frame profile 2, the first thermally insulating connecting element 10 and the second window frame profile 7 form an integrated whole, i.e. they are made of one piece of the same material or same material combination. In this way, a thermally insulated window frame structure 23 is produced from one piece, and may be used in a window frame system 1 according to the invention. The window frame structure 23 as shown in FIG. 4*b* is fully minimised by creating the integrated holders 4, 5, 9 described above for fixing respectively a flexible profile 13 and a glass lath 15, as shown in FIGS. 2 and 3, instead of protruding profile-widening holders known from the prior art.

FIG. 4*b* furthermore shows that the window frame structure 23, made for example completely out of one piece of composite, is provided with a cavity 40. It will be evident to the person skilled in the art that in this way, the heat transfer through the window frame structure 23 can be limited further while the mechanical properties remain as high as possible.

Figure 4C:
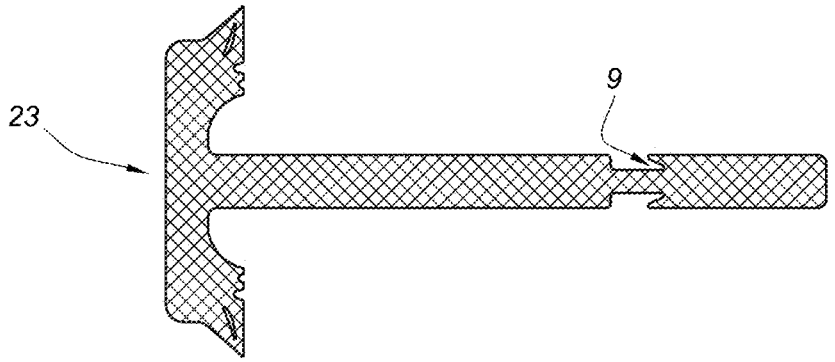
FIG. 4*c* shows a diagrammatic cross-section of yet another exemplary embodiment of a window frame structure according to the invention.

FIG. 4*c* shows a diagrammatic cross-section of yet another embodiment of a window frame structure 23 according to the invention, which is formed by the flexible sealing profiles 13, the thermally insulating connecting element 10 and the second window frame profile 7—as shown in FIGS. 2 and 3—being integrated into a whole by producing these of the same material, i.e. from one piece of the same material or same material combination. The window frame structure 23 shown in FIG. 4*c* may furthermore be made for example from one piece of flexible material, armoured or otherwise, for example a rubber, armoured or otherwise, with the mechanical and strength properties which are suitable for use in a window frame system according to the invention. In this way, the window frame structure 23 may be made from one piece, which makes the use of the first aluminium window frame profile 2 shown in FIGS. 2, 3 and 4*a* superfluous.

Figure 5A:
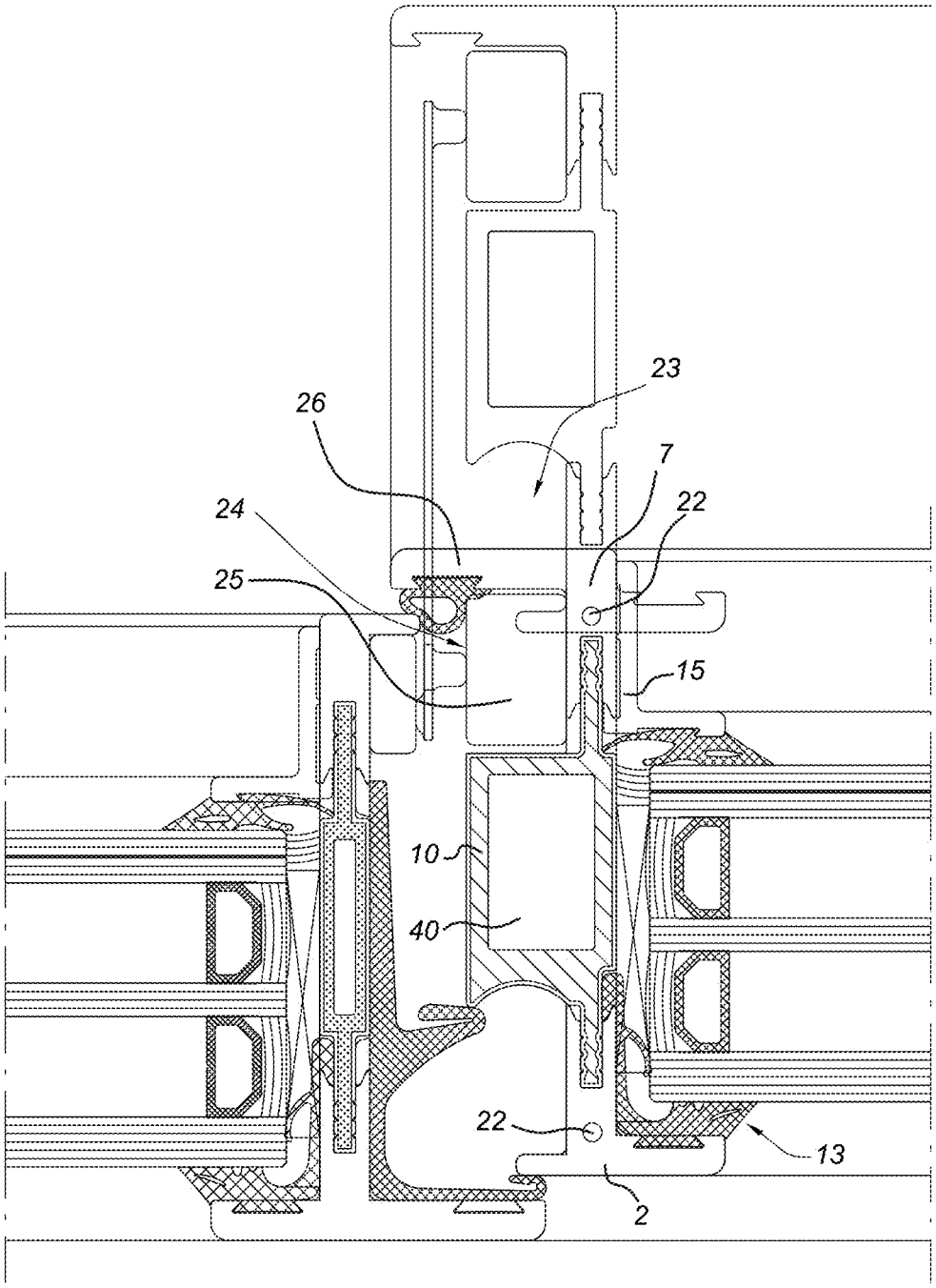
FIG. 5*a* shows a diagrammatic cross-section of an embodiment of a window frame system according to the invention in which a first motor of a control system is positioned relative to a first post of a first window frame structure.

The window frame structure 23 shown in FIG. 4*c* is also fully minimised by creating the integrated holder 9 for fixing of a glass lath 15—as shown in FIGS. 2 and 3—instead of protruding, profile-widening holders as known from the prior art. FIG. 5*a* shows a diagrammatic cross-section of an embodiment of a window frame system 1 according to the invention, in which a first motor 25 of a control system 24 is positioned relative to a first post 26 of a first window frame structure 23. The control system 24 is configured for controlling the first motor 25, which is configured for opening and/or closing the first window frame structure 23. The control system 24 may be configured for autonomously opening and/or closing the first window frame structure 23 depending on local environmental factors, such as the $CO_2$ concentration, temperature and relative humidity of the ambient air. By using an autonomous control system 24 according to the invention in a window frame system 1 according to the invention, it is possible to regulate ventilation locally (per window frame, per room). No central control system is required. Each control system 24 according to the invention individually controls the respective window leaves in order to create the necessary ventilation. The ventilation can thus be regulated with great accuracy. If ventilation is required locally, ventilation is provided, and if no ventilation is required, no ventilation is provided.

Figure 5B:
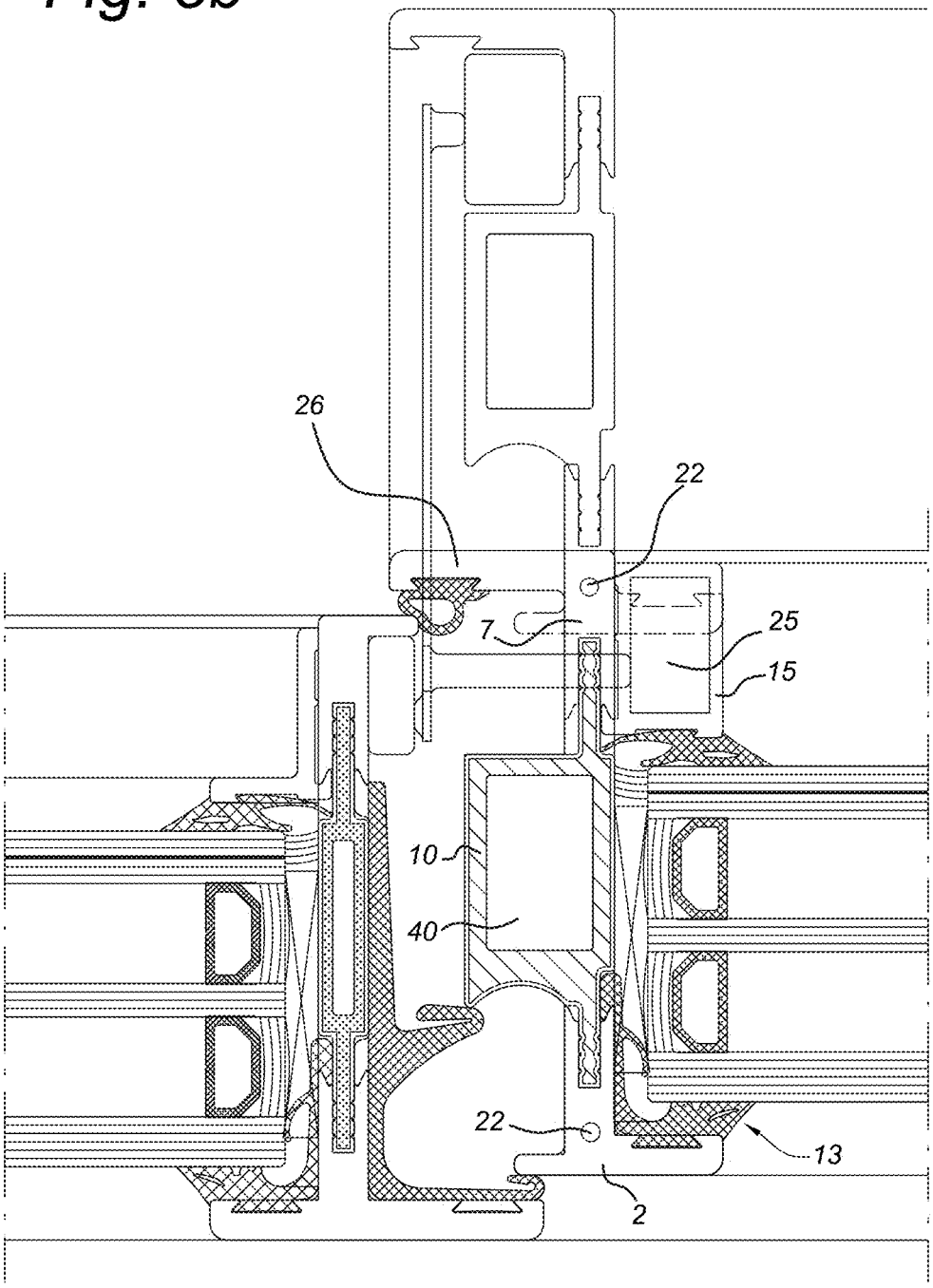
FIG. 5*b* shows a diagrammatic cross-section of another embodiment of a window frame system according to the invention in which a first motor of a control system is integrated in a first glass lath of a first window frame structure.

FIG. 5*b* shows a diagrammatic cross-section of another embodiment of a window frame system 1 according to the invention, in which the first motor 25 of the control system 24 is integrated in the first glass lath 15 of the first window frame structure 23.

Figure 6:
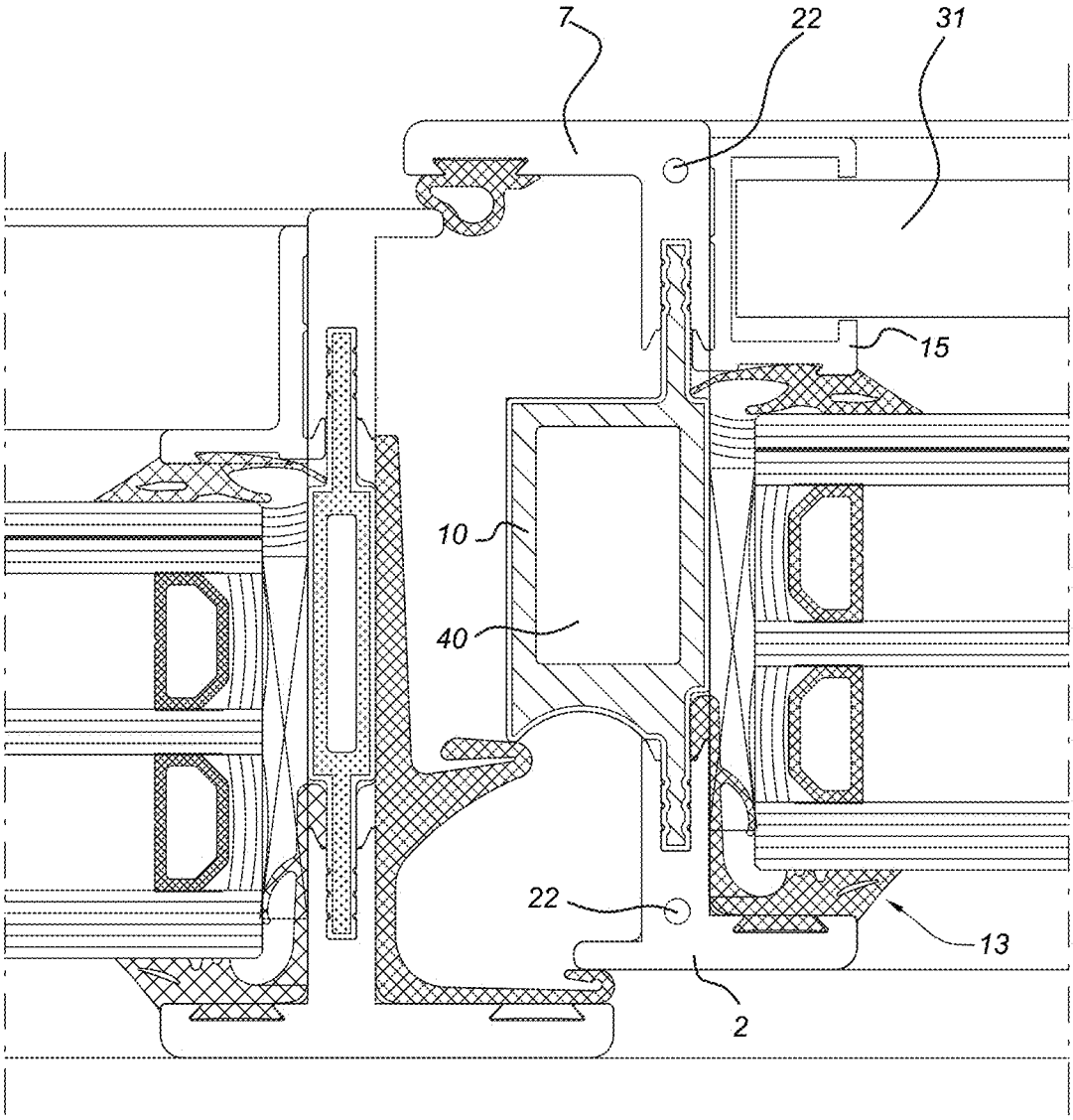
FIG. 6 shows a diagrammatic cross-section of a further embodiment of a window frame system according to the invention in which a sun protection system is integrated with a first glass lath of a first window frame structure of the window frame system.

FIG. 6 shows a diagrammatic cross-section of a further embodiment of a window frame system 1 according to the invention, in which a sun protection system 31 is integrated with the first glass lath 15 of the first window frame structure 23 of the window frame system 1. In this way, it is possible to ensure a minimum width of the window frame structure. The sun protection system 31 according to the invention may comprise at least one of blinds and a screen.

Figure 7:
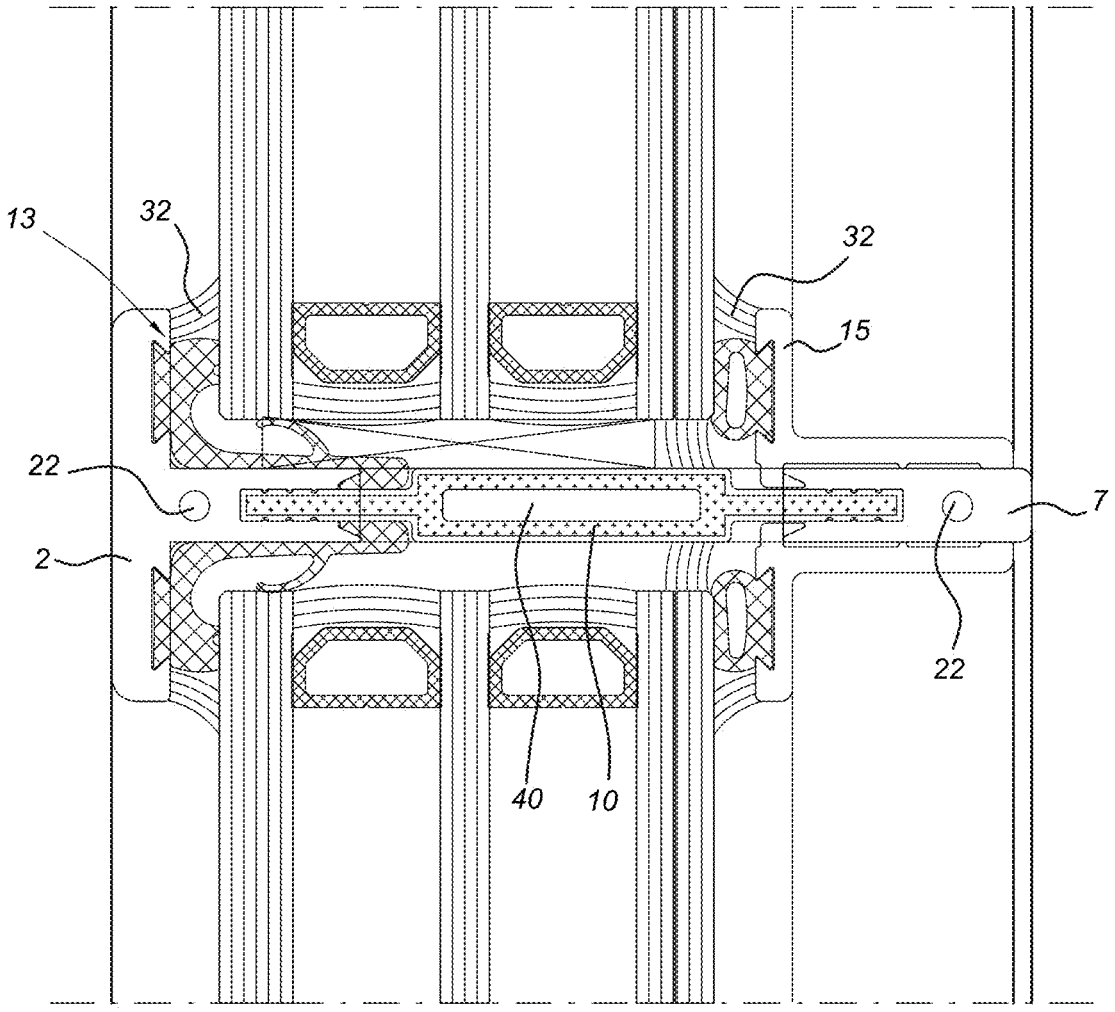
FIG. 7 shows a diagrammatic cross-section of another embodiment of a window frame system according to the invention which is provided with a second flexible profile.

FIG. 7 shows a diagrammatic cross-section of another embodiment of a window frame system 1 according to the invention, which is provided with a second flexible profile 32 applied to a side of the first glass lath 15 which is directed towards a second plate 18 of the first panel 70 received in the window frame system 1. The second flexible profile 32 serves to close an opening between the second window frame profile 7 and the second plate 18. FIG. 7 furthermore shows that the second flexible profile 32 is applied over the first flexible profile 13 to close an opening between the first window frame profile 2 and the first plate 17 of the first panel 70. In the embodiment of the window frame system 1 according to the invention, the second flexible profile 32 comprises a mastic. As already described above, this aspect of the invention relates to glazing seals, i.e. the seals for glazing and panels which are formed such that a wet glazing seal or mastic may be applied. This seal allows the glazing to be applied with hook-mounted or click-fit glass laths 15, after which a wet seal is applied by means of mastic 32.

The present invention is not restricted to the non-limitative exemplary embodiments described above. The scope of protection is determined by the extent of the following claims, within the scope of which many modifications and technical equivalents are conceivable.

The invention claimed is:

1. A window frame system configured to fix at least one first panel, the window frame system comprising:

at least a first window frame structure comprising at least a first window frame profile which is provided with at least a first holder, a second holder, and a third holder, at least a second window frame profile defining at least a fourth holder and a fifth holder, the fifth holder being defined by a portion of the second window frame profile at an end of the fourth holder directed to the center of window frame system, the second window frame profile being configured to be positioned relative to the first window frame profile, the first, the second, and the third holders being oriented towards the fourth and the fifth holders, at least a first thermally insulating element which has at least a first end and a second end, the first end being configured to be received in the first holder and the second end being configured to be received in the fourth holder to connect together the first and the second window frame profiles, at least a first flexible profile comprising a first sealing element configured to be positioned in lying contact with at least the first window frame profile and a first plate of a first panel configured to be received in the window frame system, a first coupling element configured to be received by form-fit in the third holder, and a second coupling element configured to be received by form-fit in the second holder of the first window frame profile, at least a first glass lath configured to be coupled to a second plate of the first panel that is configured to be received in the window frame system, the first glass lath comprising at least a third coupling element configured to be received by form-fit in the fifth holder of the second window frame profile, wherein the second and the third holders of the first window frame profile, and the fifth holder of the second window frame profile, in use of the window frame system, comprise at least one internal corner with a radius smaller than 0.5 mm.

2. The window frame system according to claim 1, wherein the first holder and the third holder of the first window frame profile are integrated.

3. The window frame system according to claim 2, wherein the fourth holder and the fifth holder of the second window frame profile are integrated.

4. The window frame system according to claim 2, wherein the first end of the first thermally insulating connecting element is configured to be glued to the first holder of the first window frame profile, and the second end of the first thermally insulating connecting element is configured to be glued to the fourth holder of the second window frame profile.

5. The window frame system according to claim 2, wherein the at least first thermally insulating connecting element is provided with at least one cavity.

6. The window frame system according to claim 1, wherein the first end of the first thermally insulating connecting element is configured to be glued to the first holder of the first window frame profile, and the second end of the first thermally insulating connecting element is configured to be glued to the fourth holder of the second window frame profile.

7. The window frame system according to claim 1, wherein the at least first thermally insulating connecting element is provided with at least one cavity.

8. The window frame system according to claim 1, wherein the at least first thermally insulating connecting element has a thermal conduction coefficient which is smaller by at least two orders of magnitude than the thermal conduction coefficient of the at least first and second window frame profiles.

9. The window frame system according to claim 1, wherein the at least first thermally insulating connecting element comprises a fiber-reinforced material.

10. The window frame system according to claim 1, wherein the at least first flexible profile comprises a second sealing element configured to be positioned in lying contact with at least the first window frame profile and the first plate of the first panel, at least the first and the second sealing elements forming at least a first channel configured to discharge a fluid which penetrates past the first sealing element during use of the window frame system.

11. The window frame system according to claim 1, wherein the at least one first thermally insulating connecting element comprises a first thermally insulating material with first thermally insulating properties, and the at least first plate comprises a second thermally insulating material with second thermally insulating properties.

12. The window frame system according to claim 11, wherein the first thermally insulating properties of the first thermally insulating material and the second thermally insulating properties of the second thermally insulating material are the same.

13. The window frame system according to claim 1, wherein the window frame system comprises at least one of a biological material, a plastic, a composite material, and a flexible material.

14. The window frame system according to claim 1, wherein the at least first thermally insulating connecting element comprises at least one of a biological material, a plastic, a flexible material, and a composite material.

15. The window frame system according to claim 13, wherein the flexible material comprises an armored flexible material.

16. The window frame system according to claim 1, wherein the window frame system comprises a fiber-reinforced material.

17. The window frame system according to claim 1, wherein the at least first thermally insulating element is provided with at least one of a sixth holder and a seventh holder, the sixth holder being oriented towards the second end and the seventh holder being oriented towards the first end, the first sealing element is configured to be coupled to at least the first window frame profile and the first plate of the first panel is configured to be received in the window frame system, and the first glass lath is configured be coupled to the at least first thermally insulating element, the second holder of the at least first window frame profile and one or more of the sixth holder and the seventh holder of the at least first thermally insulating element comprising at least one internal corner with a radius which is smaller than 0.5 mm.

* * * * *